US005888715A

United States Patent [19]

Hiyama et al.

[11] Patent Number: 5,888,715

[45] Date of Patent: Mar. 30, 1999

[54] SILVER HALIDE COLOR PHOTOGRAPHIC LIGHT-SENSITIVE MATERIAL

[75] Inventors: Kunimasa Hiyama; Hiroshi Kita; Hirokazu Sato, all of Tokyo, Japan

[73] Assignee: Konica Corporation, Japan

[21] Appl. No.: 843,335

[22] Filed: Apr. 15, 1997

[30] Foreign Application Priority Data

Mar. 10, 1995 [JP] Japan ..... 6-051167
Oct. 25, 1995 [JP] Japan ..... 6-275830

[51] Int. Cl.[6] ..... G03C 1/08; G03C 7/26; G03C 7/32

[52] U.S. Cl. ..... 430/546; 430/558; 430/631

[58] Field of Search ..... 430/546, 558, 430/502, 631

[56] References Cited

U.S. PATENT DOCUMENTS 5,376,520 12/1994 Kita ..... 430/546
5,411,847 5/1995 Leppard et al. ..... 430/551
5,468,600 11/1995 Watanabe ..... 430/546

FOREIGN PATENT DOCUMENTS 0136924 4/1985 European Pat. Off. .
52-46816 4/1977 Japan .

*Primary Examiner*—Geraldine Letscher
*Attorney, Agent, or Firm*—Jordan B. Bierman; Bierman, Muserlian and Lucas

[57] ABSTRACT

A silver halide color photographic material comprises a support and provided thereon a silver halide emulsion layer, wherein the material comprises a water-insoluble alcoholic compound having a hydroxy group forming an intramolecular hydrogen bond.

12 Claims, 2 Drawing Sheets

SILVER HALIDE COLOR PHOTOGRAPHIC LIGHT-SENSITIVE MATERIAL

FIELD OF THE INVENTION

The present invention relates to a silver halide color photographic light sensitive material and particularly to a silver halide color photographic light sensitive material, which can provide an excellent dye-forming efficiency, a dye image with excellent light fastness, and improved color reproduction after extended storage.

BACKGROUND OF THE INVENTION

In the field of silver halide color photographic light sensitive material, which is hereinafter referred to as "color light sensitive material" or simply as "light sensitive material", it is necessary to obtain a dye image with sufficient maximum density (excellent dye-forming efficiency) produced by effective reaction of a coupler with an oxidation product of a color developing agent. Further, it is desired that the obtained dye image does not easily fade away or discolors even when it is exposed to light for a long time or when it is stored under conditions of high temperature and high humidity.

However, recent demand for rapid processing has brought about disadvantages in reaction of a coupler with an oxidation product of a color developing agent.

In order to improve the coupler reaction, it is well known that more hydrophilic high boiling point organic solvent is used. However, it has been found that, when a coupler-containing silver halide emulsion layer closest to the support of light sensitive material, which is most difficult to color develop, color mixture is produced after storage, resulting in marked lowering of color reproduction.

Japanese Patent O.P.I. Publication Nos. 52-152722/1977 and 53-13414/1978 disclose a silver halide emulsion layer closest to the support of light sensitive material, the layer containing a saturated higher alcohol, whereby color developability in silver halide emulsion layers closer to the support as well as in the layer closest to the support is improved. However, it has also been found that this technique has the disadvantages in that color mixture improvement is insufficient and light fastness of the obtained dye image is deteriorated.

As a method improving a dye-forming efficiency of a coupler is disclosed in Japanese Patent O.P.I. Publication Nos. 7-84350/1995 and 63-11935/1988 a technique employing a glycerin derivative for a high boiling point organic solvent, however, there are the problems that the use of these compounds disclosed in these patent specifications results in dye image light fastness lowering and in dye image bleeding after storage under high temperature and high humidity, although the dye-forming efficiency is increased.

There is the disclosure in U.S. Pat. Nos. 3,725,067, 3,758,309 and 3,810,761 that a pyrazole magenta coupler gives a dye image having reduced side absorption in the blue wavelength range and preferable in color reproduction as compared with a 5-pyrazolone magenta coupler. However, the azomethine dye formed from the pyrazoloazole magenta coupler is markedly low in light fastness, resulting in lowering of quality of a color photographic light sensitive material, particularly a color photographic light sensitive material for color print.

As a method to enhance light fastness is known a technique in which a phenol or phenylether compound disclosed in Japanese Patent O.P.I. Publication Nos. 59-125732/1984, 61-282845/1986, 61-292639/1986 and 61-279855/1986 or an amine compound disclosed in Japanese Patent O.P.I. Publication Nos. 61-72246/1986, 62-208048/1987, 62-157031/1987 is used in combination with a pyrazoloazole magenta coupler, but this technique is insufficient to enhance the light fastness. Thus, the improvement has been eagerly required.

SUMMARY OF THE INVENTION

Figure 1:
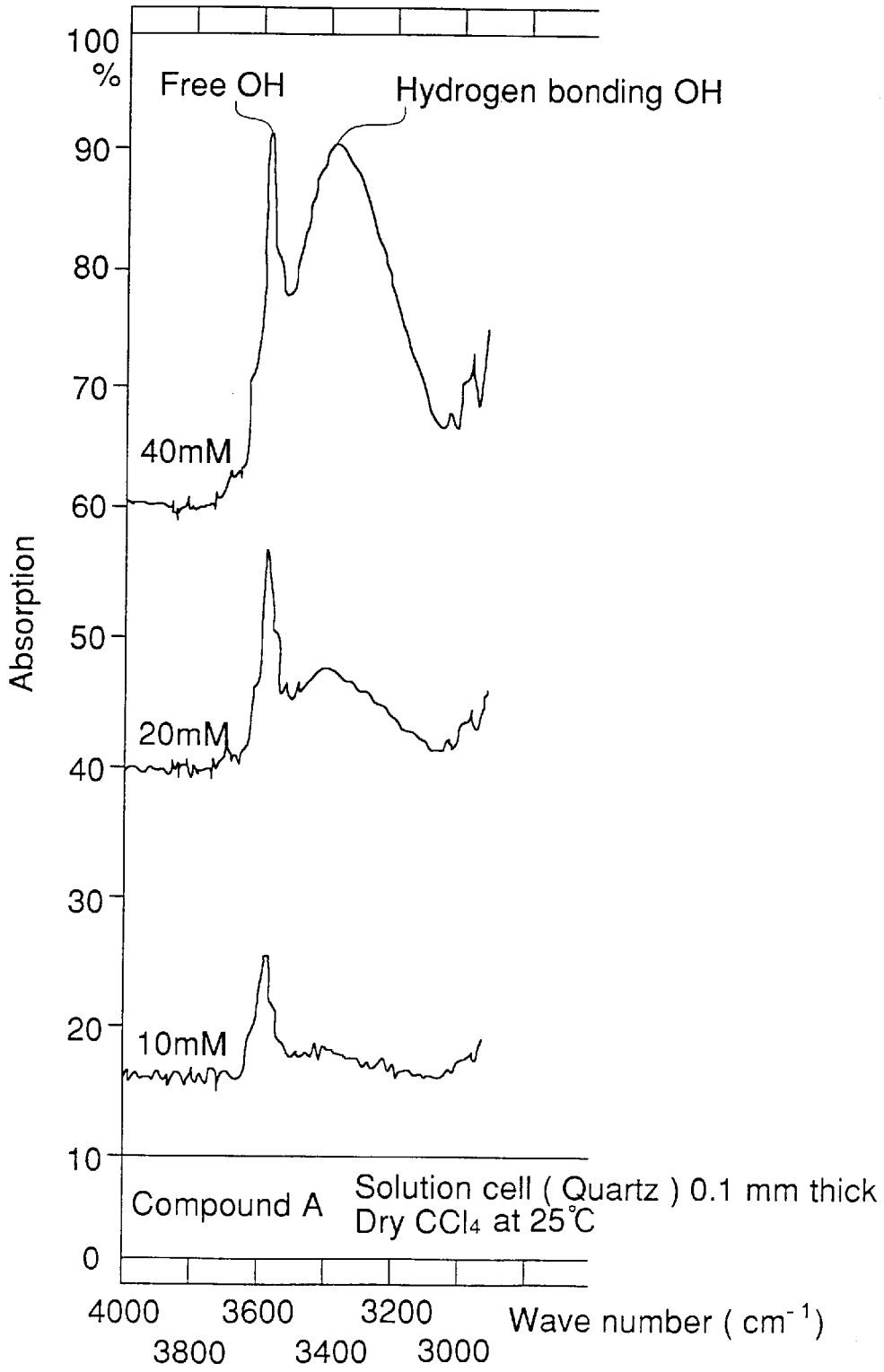
FIG. 1 shows infrared absorption spectra of 10 mM, 20 mM and 40 mM alcoholic compound A-4 (described later) solutions. The axis of the ordinates shows absorption (%), and the axis of the abscissas shows wave number ($cm^{-1}$).

Accordingly, an object of the invention is to provide a silver halide color photographic light sensitive material which can provide an excellent dye-forming efficiency of couplers, a dye image with excellent light fastness, and improved color reproduction after extended storage.

Another object of the invention is to provide a silver halide color photographic light sensitive material which can provide an excellent dye-forming efficiency of couplers, a dye image with excellent light fastness, and reduced bleed of a dye image after storage under high temperature and high humidity.

Still another object of the invention is to provide a coupler dispersion solution with excellent stability.

DETAILED DESCRIPTION OF THE INVENTION

The above object of the invention could be attained by the following silver halide color photographic material:

(1) A silver halide color photographic material comprising at least one alcoholic compound having a hydroxy group which forms an intramolecular hydrogen bond, (2) the silver halide color photographic material of 1 above, wherein the content of the hydroxy group which forms an intramolecular hydrogen bond is 10% or more based on the total content of the hydroxy group in the alcoholic compound, (3) the silver halide color photographic material of (1) or (2) above, wherein a silver halide emulsion of the silver halide color photographic material contains the alcoholic compound and at least one magenta coupler represented by the following formula (M-I):

formula (M-I)

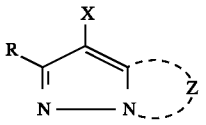

wherein Z represents a non-metallic atomic group necessary to form a nitrogen containing heterocyclic ring, wherein Z may have a substituent; X represents a hydrogen atom or a group capable of being released on reaction with an oxidation product of a color developing agent; and R represents a hydrogen atom or a substituent, (4) the silver halide color photographic material of (3) above, wherein the alcoholic compound is represented by the following formula (A-I):

$$Ar—O—R^1 \qquad \text{formula (A-I)}$$

wherein Ar represents a substituted or unsubstituted aryl group; and $R^1$ represents a substituted alkyl group having one or more hydroxy group, (5) the silver halide color photographic material of (3) above, wherein the alcoholic compound is represented by the following formula (A-II):

formula (A-II)

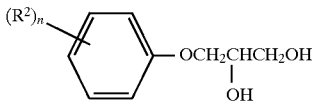

wherein $R^2$ represents a hydrogen atom or a monovalent substituent; and n represents an integer of 1 to 5, provided that when n is 2, plural $R^2$s are the same or different, (6) A silver halide color photographic material comprising at least one alcoholic compound represented by the following formula (A):

formula (A)

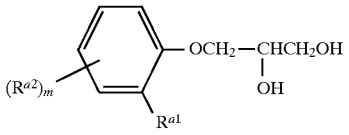

wherein $R^{a1}$ represents a substituent; $R^{a2}$ represents a hydrogen atom or a substituent; and m is an integer of 0 to 4, provided that when m is 2 or more, plural $R^{a2}$ may be the same or different and the total carbon atom number contained in $R^{a1}$ and $R^{a2}$ is 12 to 36, (7) The silver halide color photographic material of (1) above, wherein the alcoholic compound represented by formula (A) and at least one magenta image forming coupler represented by the following formula (M-I) are contained in the same silver halide emulsion layer:

formula (M-I)

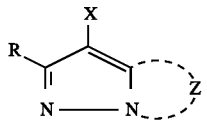

wherein Z represents an non-metallic atomic group necessary to form a nitrogen containing heterocyclic ring, wherein Z may have a substituent; X represents a hydrogen atom or a group capable of being released on reaction with an oxidation product of a color developing agent; and R represents a hydrogen atom or a substituent, (8) The silver halide color photographic material of (7) above, wherein the magenta image forming coupler is represented by the following formula (M-A):

formula (M-A)

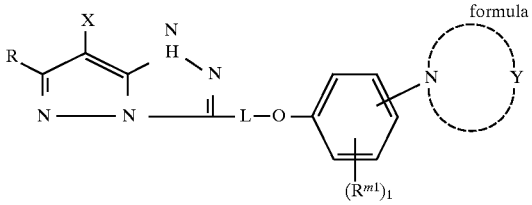

wherein R represents a hydrogen atom or a substituent; L represents a divalent linkage group, $R^{m1}$ represents a substituent; Y represents an non-metallic atomic group necessary to form a 5- or 6-membered heterocyclic ring; and 1 is an integer of 0 to 4, (9) The silver halide color photographic material of (1) above, wherein an image stabilizer represented by the following formula (S-I) is contained in an emulsion layer containing a magenta image forming coupler:

formula (S-I)

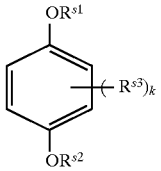

wherein $R^{s1}$ and $R^{s2}$ independently represent hydrogen atom, an aliphatic group or an aromatic group; $R^{s3}$ represents a substituent; and k is an integer of 0 to 4, provided that when k is 2 or more, plural $R^{s3}$ may be the same or different, and when plural $R^{s3}$ are adjacent to each other, plural $R^{s3}$ may combine with each other to form a ring, and $R^{s1}$ and $R^{s2}$ are not simultaneously hydrogen atoms, or

(10) The silver halide color photographic material of (9) above, wherein the magenta forming coupler is represented by formula (M-A) above,

(11) A silver halide color photographic material comprising a support and provided thereon, a silver halide emulsion layer, the silver halide emulsion layer comprising an alcoholic compound represented by the following formula (A1):

formula (A1)

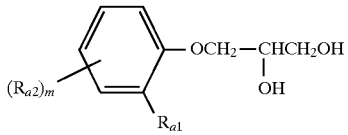

wherein $R_{a1}$ and $R_{a2}$ each represent a (t,s) $C_9H_{19}$ group; and m is an integer of 1 to 3, provided that the total carbon atom number contained in $R_{a1}$ and $R_{a2}$ is 18 to 36,

(12) The silver halide color photographic material of 11 above, wherein said alcoholic compound is represented by the following formula:

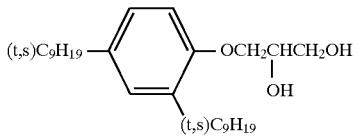

(13) The silver halide color photographic material of 12 above, wherein said silver halide emulsion layer contains a coupler in an amount of $1\times10^{-3}$ to 1 mol per mol of silver halide and said alcoholic compound in an amount of 0.01 to 20 g per 1 g of coupler, or

(14) The silver halide color photographic material of 1 above, wherein said silver halide emulsion layer contains silver halide grains having a silver chloride content of 95 mol % or more.

Next, the invention will be explained in detail.

The water insoluble alcoholic compound used in the invention has a hydroxy group which forms an intramolecular hydrogen bond, wherein the content of the hydroxy group which forms an intramolecular hydrogen bond is preferably 10% or more at 25° C. based on the total content of the hydroxy group in the alcoholic compound.

The "water insoluble alcoholic compound" herein referred to is defined to be an alcoholic compound having a water solubility at 25° C. of less than 1% by weight. The water solubility is in terms of an amount by weight of a solute capable of being dissolved in 100 g of 25° C. water.

The content ratio of the hydroxy group which forms an intramolecular hydrogen bond to the total content of the hydroxy group in the alcoholic compound can be measured according to a method described in "Gouseijushi Kogyo, 35, 12 (1988). The method is as follows:

The alcoholic compound is dissolved in dry carbon tetrachloride to obtain a solution having concentration of 10 cc/liter, 20 cc/liter, or 40 cc/liter. One cc of each solution is incorporated into a cell of a rock salt solution, and subjected to infrared spectrometry. "Yukikagobutsu no supekutoru niyoru dotei", forth edition, pages 108–110, Silverstein et al., Tokyo Kagakudojin (1983) reads that in the spectra the free hydroxy group shows a sharp absorption in the range of from 3700 to 3600 $cm^{-1}$, and the hydroxy group which forms an intramolecular hydrogen bond shows a broad absorption in the range of from 3500 to 3200 $cm^{-1}$.

The value of the optical density of each carbon tetrachloride solution minus the optical density of carbon tetrachloride itself leads to the absorption ratio (hydroxy group which forms an intramolecular hydrogen bond/hydroxy group which forms an intramolecular hydrogen bond+free hydroxy group) is obtained. The resulting ratios are plotted against alcoholic compound concentrations of solutions to obtain ratio/concentration graph.

Figure 2:
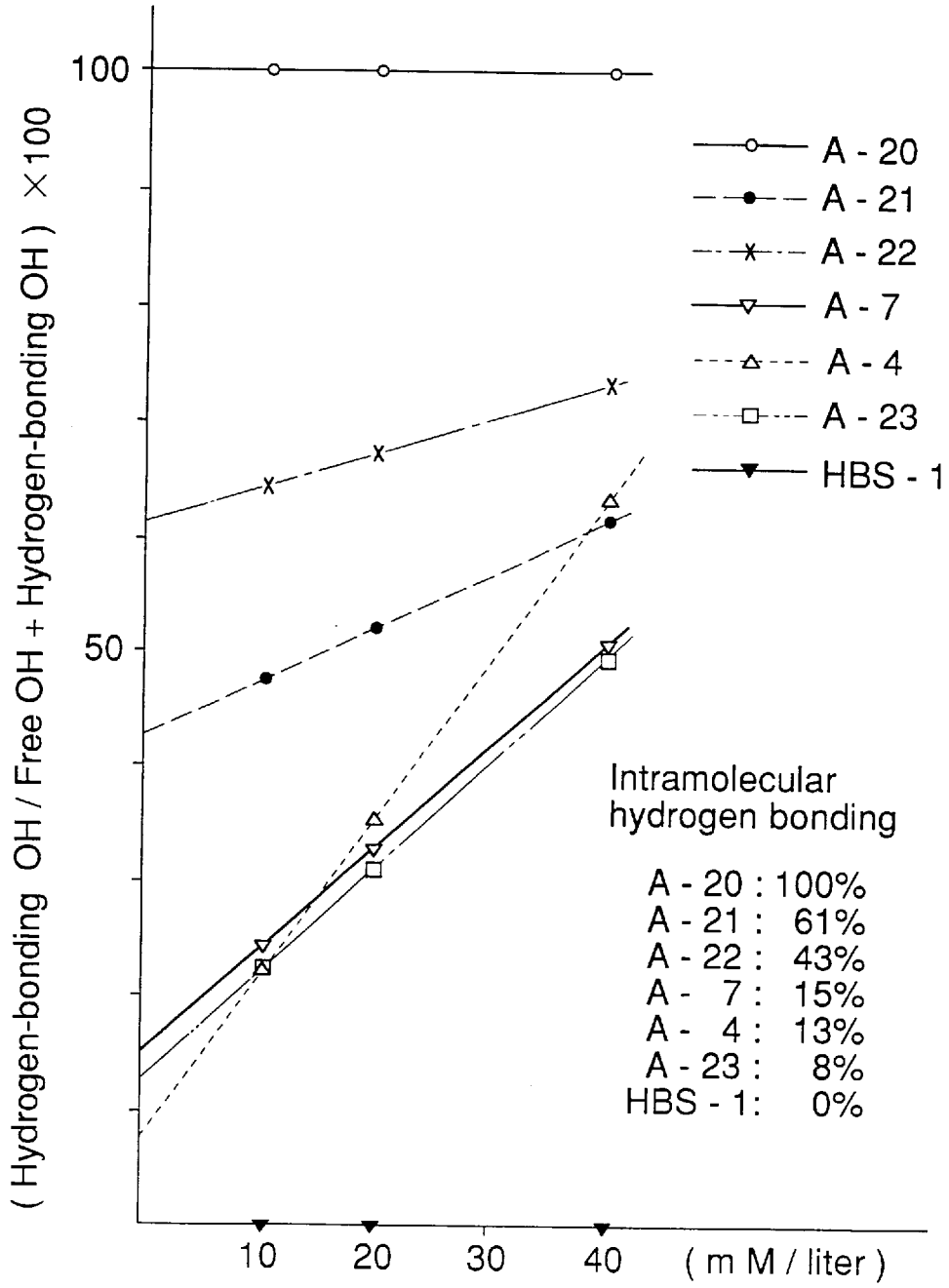
FIG. 2 shows a figure in which the absorption ratios of the hydroxy group which forms an intramolecular hydrogen bond to the total content of the hydroxy group in alcoholic compounds are plotted against concentrations of the alcoholic compounds in dry $CCl_4$ solutions. The axis of the ordinates shows (hydroxy group which forms an intramolecular hydrogen bond/hydroxy group which forms an intramolecular hydrogen bond+free hydroxy group), and the axis of the abscissas shows concentration.

The resulting straight line intercept, extrapolated to a concentration of zero is defined as the intramolecular hydrogen bonding ratio (see FIGS. 1 and 2).

The alcoholic compound used in the invention includes polyhydric alcohols which form an intramolecular hydrogen bond, such as 1,2-diols, fatty acid glycerides, pentaerythritol esters and sorbitan esters, but the alcoholic compound represented by the above formula (A-I) or (A-II) is preferable in that the compound is effected in the invention.

The substituted or unsubstituted aryl group represented by Ar of formula (A-I) includes a substituted or unsubstituted phenyl and naphthyl group, and preferably a substituted or unsubstituted phenyl group. The substituent is not limited, but includes an alkyl, alkoxy, acyl, acylamino, carbamoyl, alkoxycarbonyl, aryloxycarbonyl, cyano and sulfonyl group and a halogen atom. The substituent is preferably an alkyl or alkoxy group.

The substituted alkyl group represented by $R^1$ has at least one hydroxy group, and may further have a substituent other than a hydroxy group. The substituent is not limited, but includes an acyloxy, sulfonyloxy, alkoxy, aryl, amino, acylamino and carbamoyl group and a halogen atom. The substituent is preferably an acyloxy or sulfonyloxy group.

The substituent represented by $R^2$ of formula (A-II) is not limited, but preferably includes the same group as the substituent denoted in Ar of formula (A-I). The substituent is more preferably an alkyl or alkoxy group. When n is 2 or more, plural $R^2$'s may combine with each other to form a condensed ring.

The alcoholic compound represented by formula (A) will be explained below.

In formula (A), the substituent of $R^{a1}$ is not specifically limited, but represents preferably an alkyl, alkenyl, alkoxy, aryloxy, acyl, acylamino, carbamoyl, alkoxycarbonyl, aryloxycarbonyl, cyano, sulfonyl or hydroxy group or a halogen atom, more preferably an alkyl, aryl or alkoxy group or a halogen atom, and most preferably an alkyl group.

In formula (A), the substituent of $R^{a2}$ is the same as those of $R^{a1}$, provided that $R^{a1}$ and $R^{a1}$ may combine with each other to form a ring or when m is 2 or more, plural $R^{a2}$ may combine with each other to form a ring but when $R^{a1}$ is a halogen atom, $R^{a2}$ represents preferably an alkyl, aryl or alkoxy group.

The total carbon atom number contained in $R^{a1}$ and $R^{a2}$ is 12 to 36.

(Synthetic Method)

The alcoholic compound represented by formula (A) can be easily synthesized according to the general synthetic method as shown in the following scheme:

(Synthetic Scheme)

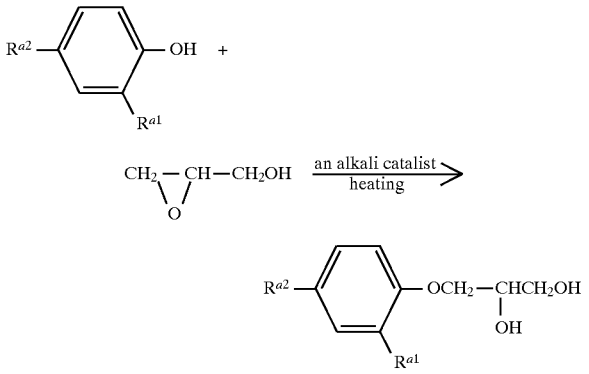

(Synthetic Example of A-25 described later)

2,4-dinonylphenol of 34.6 g was mixed with 0.30 g of powdered sodium hydroxide and the resulting mixture was heated to 120° C. To the mixture 7.4 g of glycidol were gradually added over about 30 minutes, and sitirred at 130° C. for additional one hour. The raction mixture was cooled to about 60° C., dispersed in a mixture solution of 200 ml ethyl acetate, a 100 ml sodium chloride solution and a 10 ml 1N hydrochloric acid and washed three times with a 100 ml sodium chloride solution. The resulting organic solution phase was dried over anhydrous magnesium sulfate and the ethyl acetate was removed by evaporation under reduced pressure. Thus, 42.0 g of yellow oil product 1 were obtained.

Product 1 of 20.0 g were subjected to silica gel column chromatography employing ethyl acetate/hexane as an eluent. Thus, 16.7 g of purified yellow oil product A-25 were obtained. (The product was identified through gas chromatography, $^1$HNMR and a FD mass spectrum method.)

In the invention, a purified compound substance such as product A-25 purified according to a column chromatography or a crude compound (containing a small amount of a side product) such as oil product 1 may be used, and it has been found that there is no difference between both compounds. (The purifying method includes a distillation or recrystallization method besides the column chromatography method.)

The exemplified compound (hereinafter referred to as the compound of the invention) of formula (A-I) or (A-II) will be shown below, but is not limited thereto.
A-1
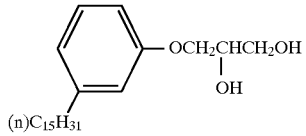
A-2
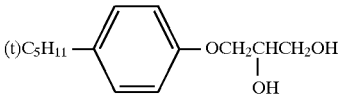
A-3
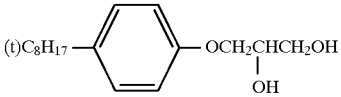
A-4
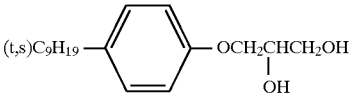
A-5
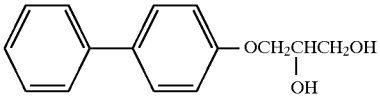
A-6
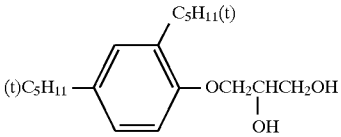
A-8
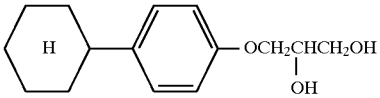
A-9
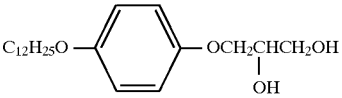
A-10
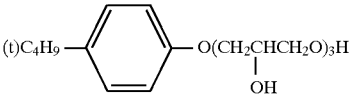
A-11
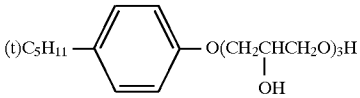
A-12
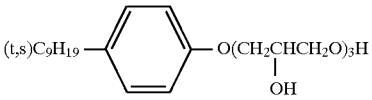
A-13
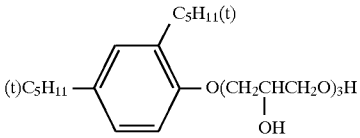
A-14
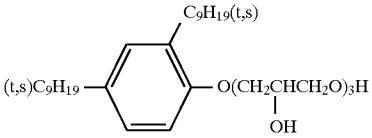
-continued
A-15
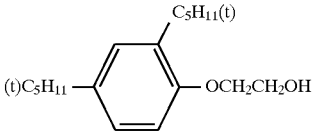
A-16
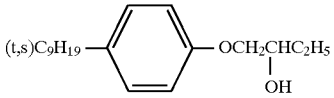
A-17
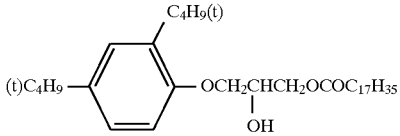
A-18
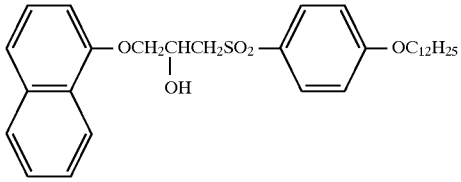
A-19
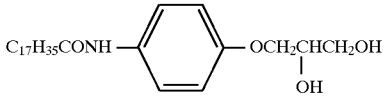
A-24
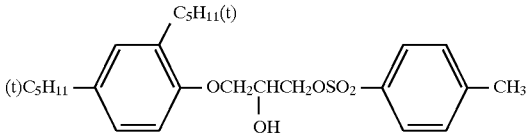
A-25
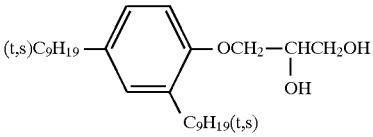
A-26
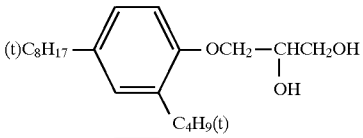
A-27
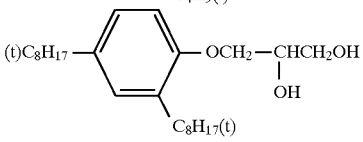
A-28
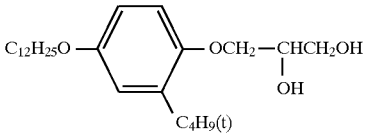
A-29
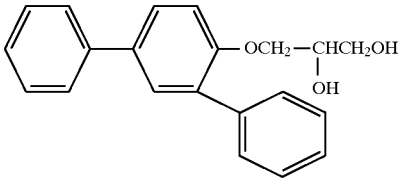

-continued

A-30

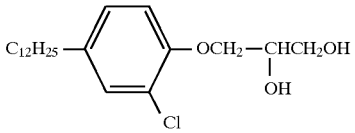

A-31

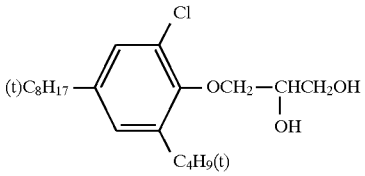

A-32

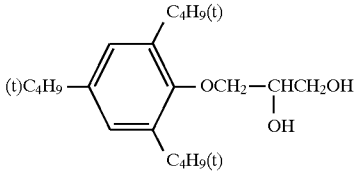

A-33

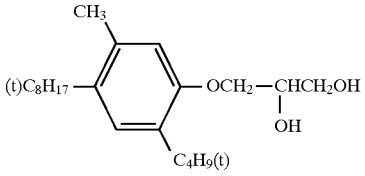

A-34

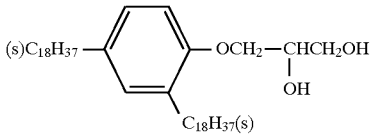

A-35

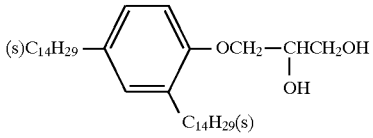

A-36

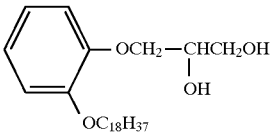

A-37

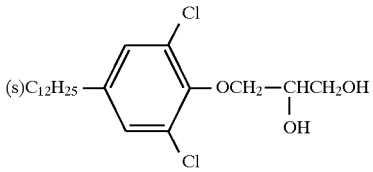

A-38

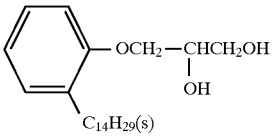

A-39

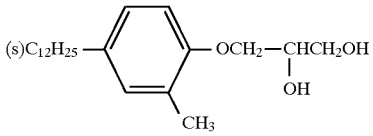

-continued

A-40

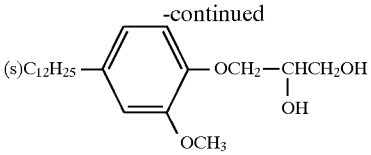

A-41

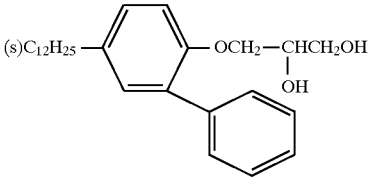

A-42

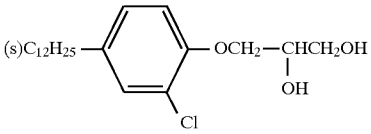

A-43

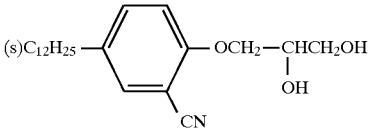

A-44

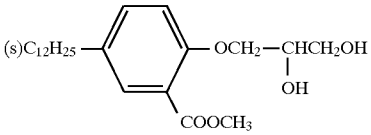

A-45

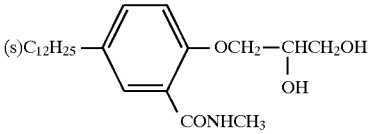

A-46

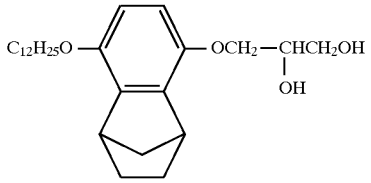

A-47

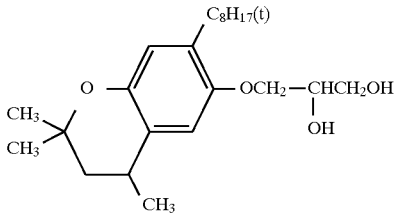

In the above chemical structures, (t,s) represents a mixture of tertiary and secondary alcohols.

The compounds used in the invention other than the compound represented by formula (A-I) or (A-II) are, for example, as follows:

A-20: sorbitan sesquioleate

A-21: pentaerythritol dioleate

A-22: diglyceryldistearate

A-23: 1,2-decane diol

Next, in the typical alcoholic compound in the invention the above intramolecular hydrogen bonding ratio will be shown below. The above intramolecular hydrogen bonding ratio is more than 0 to 100%, and preferably 10% or more in view of the effect of the invention.

| Alcohol | intramolecular hydrogen bonding ratio |
|---|---|
| A-20 | 100% |
| A-21 | 61% |
| A-22 | 43% |
| A-7 | 15% |
| A-4 | 13% |
| A-23 | 8% |
| HBS-1* | 0% |

HBS-1*: 2-hexyl-decylalcohol (comparative alcohol)

In the coupler used with the alcoholic compound in the invention, the yellow image forming coupler includes a benzoylacetoanilide or pivaloylacetoanilide type coupler, the magenta image forming coupler includes a 5-pyrazolone, pyrazolotriazole or indazolone type coupler, and the cyan image forming coupler includes a phenol, naphtol, pyrazolotriazole, pyrazolopyrimidine, pyrazoloquinazoline or imidazole type coupler. The especially preferable coupler is a magenta image forming coupler (hereinafter referred to simply as a magenta coupler) represented by the above formula (M-I), in that the invention is markedly effected.

In formula (M-I), Z represents an non-metallic atomic group necessary to form a nitrogen containing heterocyclic ring, wherein Z may have a substituent; X represents a hydrogen atom or a group capable of being released on reaction with an oxidation product of a color developing agent; and R represents a hydrogen atom or a substituent.

The substituent represented by R is not specifically limited but the typical group includes alkyl, aryl, anilino, acylamino, sulfonamido, alkylthio, arylthio, alkenyl, cycloalkyl, a halogen atom, cycloalkenyl, alkynyl, heterocyclic, sulfonyl, sulfinyl, phosphonyl, acyl, carbamoyl, sulfamoyl, cyano, alkoxy, aryloxy, heterocylic oxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclic thio, spiro compound residues, and closslinked hydrocarbon compound residues.

The alkyl group represented by R is an alkyl group having preferably 1 to carbon atoms, and is straight-chained or branched. The aryl group represented by R is preferably a phenyl group.

The acylamino group represented by R includes alkylcarbonylamino and arylcarbonylamino groups:

The sulfonamido group represented by R includes alkylsulfonylamino and arylsulfonylamino groups. The alkyl component and aryl component of the alkylthio and arylthio group represented by R correspond to the above alkyl and aryl groups, respectively.

The alkenyl group represented by R includes those having 2 to 32 carbon atoms, and may be either straight-chained or branched. The cycloalkyl group includes those having 3 to 12 carbon atoms, preferably 5 to 7 carbon atoms. The cycloalkenyl group includes those having preferably 3 to 12 carbon atoms, more preferably 5 to 7 carbon atoms.

The sulfonyl group represented by R includes alkylsulfonyl and arylsulfonyl groups; the sulfinyl group includes alkylsulfinyl and arylsulfinyl groups; the phosphonyl group includes alkylphosphonyl, arylphosphonyl, aryloxyphosphonyl and arylphosphonyl groups; the acyl group includes alkylcarbonyl and arylcarbonyl groups; the carbamoyl group includes alkylcarbamoyl and arylcarbamoyl groups; the sulfamoyl group includesalkylsulfamoyl and arylsulfamoyl groups; the acyloxy group includes alkylcarbonyloxy and arylcarbonyloxy groups; the carbamoyloxy group includes alkylcarbamoyloxy and arylcarbamoyloxy groups; the ureido group includes alkylureido and arylureido groups; the sulfamoylamino group includes alkylsulfamoylamino and arylsulfamoylamino groups; the heterocyclic group is preferably a 5- to 7-membered cyclic group such as 2-furyl, 2-thienyl, 2-pyrimidinyl and 2-benzothiazolyl groups; the heterocyclic oxy group is preferably one having a 5- to 7-member heterocyclic ring such as 3,4,5,6-tetrahydropyranyl-2-oxy and 1-phenyltetrazole-5-oxy groups; the heterocyclic thio group is preferably a 5- to 7-membered heterocyclic thio group such as 2-pyridylthio, 2-benzothiazolylthio and 2,4-diphenoxy-1,3,5-triazole-6-thio groups; the siloxy group includes trimethylsiloxy, triethylsiloxy and dimethylbutylsiloxy groups; the imido group includes succinic acid imido, 3-heptadecylsuccinic acid imido, phthalimido and glutarimido groups; the spiro compound residue includes spiro[3.3]heptane-1-yl group; the closslinked hydrocarbon compound residue includes bicyclo[2.2.1]heptane-1-yl, tricyclo[3.3.1.1$^{3\ 7}$] decane-1-yl and 7,7-dimethyl-bicyclo[2.2.1]heptane-1-yl groups.

The group represented by X capable of splitting upon reaction with an oxidation product of a color developing agent includes a halogen atom such as chlorine, bromine or fluorine, and alkoxy, aryloxy, heterocyclic oxy, acyloxy, sulfonyloxy, alkoxycarbonyloxy, aryloxycarbonyl, alkyloxalyloxy, alkoxyoxalyloxy, alkylthio, arylthio, heterocyclic thio, alkoxycarbonylthio, acylamino, sulfonamido, N atom-bonded nitrogen-containing heterocyclic, alkyloxycarbonylamino, aryloxycarbonylamino, carboxyl groups, and

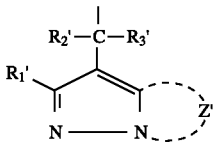

wherein $R_1$' represents the same as denoted in R above; Z' represents the same as denoted in Z above and $R_2$' and $R_3$' independently represents a hydrogen atom, alkyl group, an aryl group or a heterocyclic group. Among these, a halogen atom is preferable, and a chlorine atom is especially preferable.

The nitrogen-containing 5-membered heterocyclic group formed with Z or Z' includes pyrazole, imidazole, benzimidazole, triazole and tetrazole rings. The substituent the above rings may have includes the same as denoted in R above.

The compound represented by formula (M-I) includes a compound represented by the following formulas (M-II) through (M-VII):

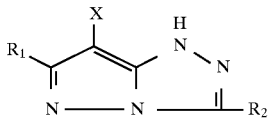

formula (M-II)

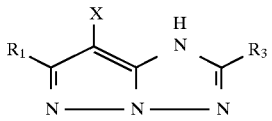

formula (M-III)

-continued

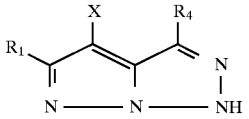

formula (M-IV)

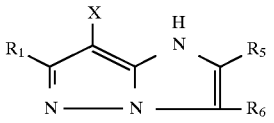

formula (M-V)

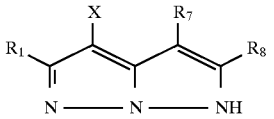

formula (M-VI)

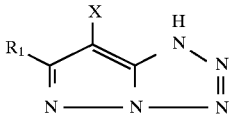

formula (M-VII)

wherein in formulas (M-II) through (M-VII), $R_1$ through $R_8$ and X independently represent the same as denoted in R and X above.

In formula (M-I), one represented by the following formula (M-VIII) is preferable:

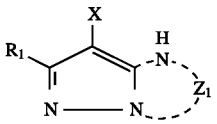

formula (M-III)

In formula (M-VIII), $R_1$, X and $Z_1$ independently represent the same as denoted in R, X and Z above.

In magenta couplers represented by formulas (M-II) through (M-VII), one represented by the following formula (M-II) is especially preferable:

The most preferable substituents $R_1$ and R above on the heterocyclic ring are one represented by the following formula:

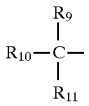

formula (M-IX)

In above formula $R_9$, $R_{10}$, and $R_{11}$ independently represent the same as denoted in R above.

The two of $R_9$, $R_{10}$, and $R_{11}$ above, for example, $R_9$ and $R_{10}$ may combine with each other to form a saturated or unsaturated ring (for example, a cycloalkane, cycloalkene or heterocyclic ring), and the above formed ring may further combine with $R_{11}$ to form a cross-linked hydrocarbon compound residue.

The preferable compound of the above formula (M-IX) is (i) a compound in which at least two of $R_9$, $R_{10}$, and $R_{11}$ are alkyl, or (ii) a compound in which at least one of $R_9$, $R_{10}$ and $R_{11}$ and the other two combine with each other to form a cycloalkyl ring, for example, $R_{11}$ is a hydrogen atom and $R_9$ and $R_{10}$ combine with each other to form a cycloalkyl ring.

The preferable compound in the above (i) is a compound in which at least two of $R_9$, $R_{10}$ and $R_{11}$ are alkyl and the other one is a hydrogen atom or alkyl.

The substituent which the ring formed by Z in formula (M-I) or formula (M-VIII) may have, and $R^2$ through $R_8$ in formulas (M-II) through (M-VI) are preferably those represented by the following formulas (M-X), (M-XI) and (M-XII):

$$-R_{12}-SO_2-R_{13} \qquad \text{formula (M-X)}$$

$$-R_{12}-NHCO-R_{13} \qquad \text{formula (M-XI)}$$

$$-R_{12}-NHSO_2-R_{13} \qquad \text{formula (M-XII)}$$

In formula, $R_{12}$ represents an alkylene group, and $R_{13}$ represents an alkyl group, a cycloalkylgroup or an aryl group.

The alkylene group represented by $R_{12}$ includes those having preferably one or more carbon atoms and more preferably 2 to 6 carbon atoms in the straight-chaned portions, and may be either straight-chained or branched. The cycloalkyl group represented by $R_{13}$ includes those having preferably 5 to 6 carbon atoms. The cycloalkenyl group includes those having preferably 3 to 12 carbon atoms, more preferably 5 to 7 carbon atoms.

The substituent represented by R in formula (M-A) is those as denoted in R of formula (M-I).

The substituent represented by $R^{m1}$ in formula (M-A) is not specifically limited. The preferable include the same as those as denoted in R of formula (M-I), and preferably are alkyl, alkoxy or halogen. 1 in formula (M-A) is an integer of 0 to 4, and preferably 0.

The divalent linkage group in formula (M-A) is preferably represented by the following formula (L-1):

$$\left(R^{01}\right)_p\left(L_1\right)_q\left(R^{02}\right)_r\left(L_2\right)_s\left(R^{03}\right)_t\left(L_3\right)_u \qquad \text{formula (L-1)}$$

wherein $R^{01}$, $R^{02}$ and $R^{03}$ independently represent an alkylene, arylene, alkylenearylene or aralkylene group having 1 to 12 carbon atoms. The alkylene group may be straight-chained or branched, and includes a methylene, methylmethylene, dimethylene, decamethylene and 1,1-dimethylethylene group. The arylene group includes phenylene and naphthylene, and the aralkylene or alkylenearylene group includes

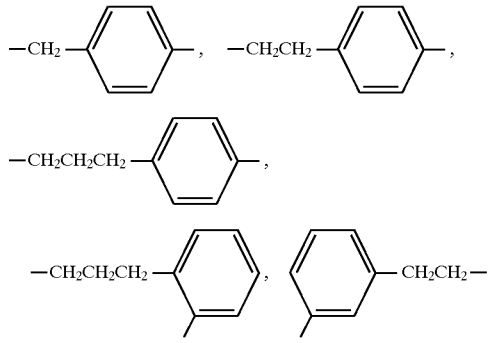

The alkylene, arylene, alkylenearylene or aralkylene group may have a substituent, and the substituent includes those as represented by R above.

In formula (L-1), $L_1$, $L_2$ and $L_3$ independently represent $$-\overset{R^{04}}{\overset{|}{N}}CO-,\quad -\overset{R^{04}}{\overset{|}{C}}ON-,\quad -OCO-,\quad -COO-,$$

$$-S-,\quad -SO-,\quad -SO_2-,\quad -CO-,\quad -O-,$$

$$-\overset{R^{04}}{\overset{|}{N}}CO-\overset{R^{04}}{\overset{|}{N}}-,\quad -OC\overset{R^{04}}{\overset{|}{O}}N-,\quad -\overset{R^{04}}{\overset{|}{N}}COO-,\quad -OCOO-,$$

-continued

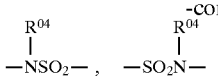

in which $R^{04}$ represents a hydrogen atom, an alkyl group or an aryl group, provided that when two $R^{04}$ are present, the two $R^{04}$ may be the same or different; p, q, r, s, t and u independently represent an integer of 0 or 1.

In Formula (M-A), the non-metal atomic group preferably comprises one selected from the structure represented by the following formula:

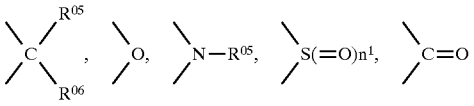

in which $R^{05}$ and $R^{06}$ independently represent a hydrogen atom, an alkyl group or an aryl group, and $n^1$ represents an integer of 0 to 2.

The preferable examples of the substituent represented by

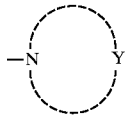

are as follows:

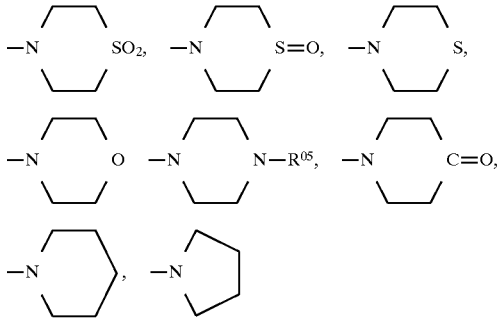

The typical examples of the magenta couplers in the invention will be shown below.

M-1

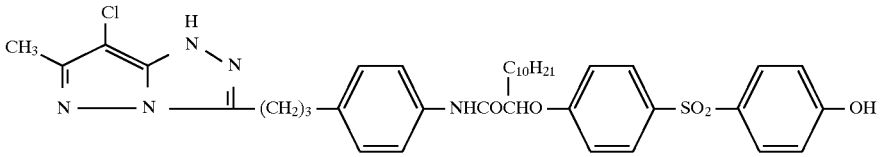

M-2

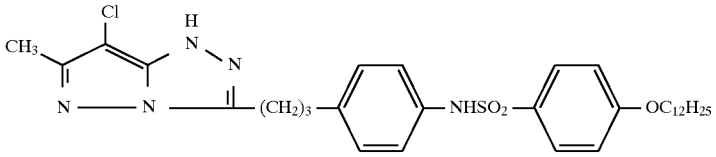

M-3

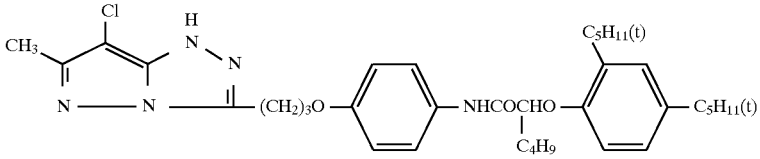

M-4

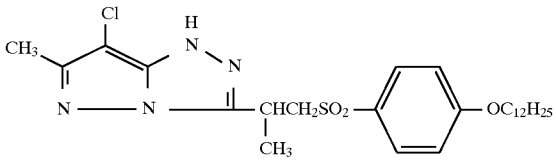

M-5

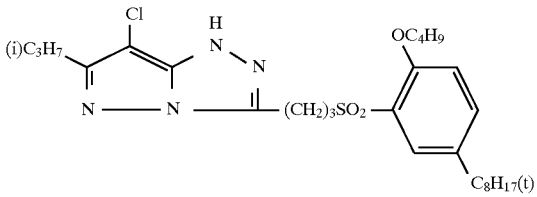

-continued
M-6
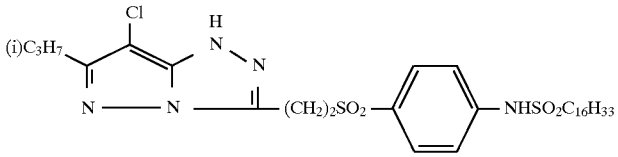
M-7
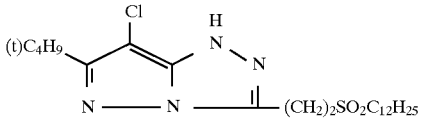
M-8
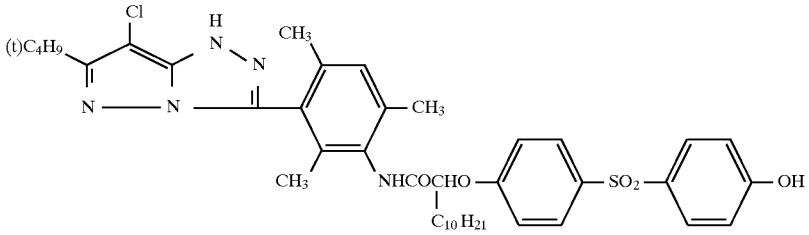
M-9
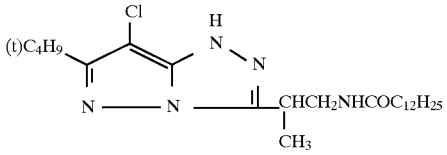
M-10
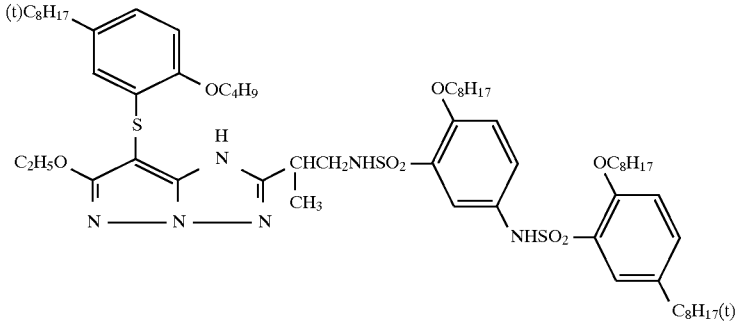
M-11
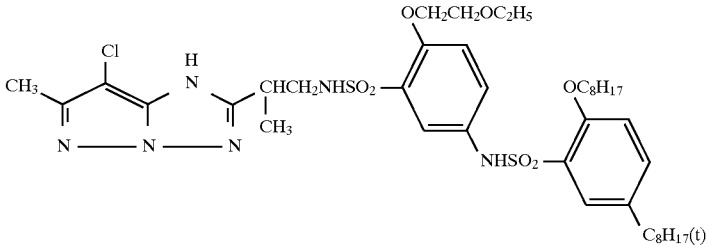
M-12
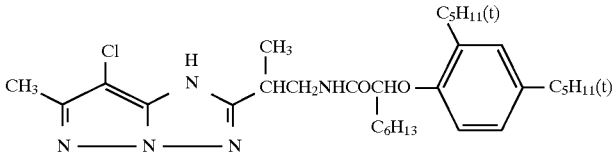
M-13
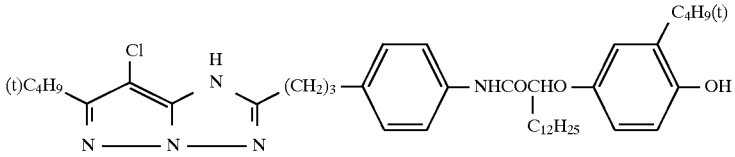

-continued
M-14
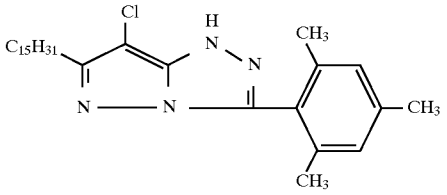
M-15
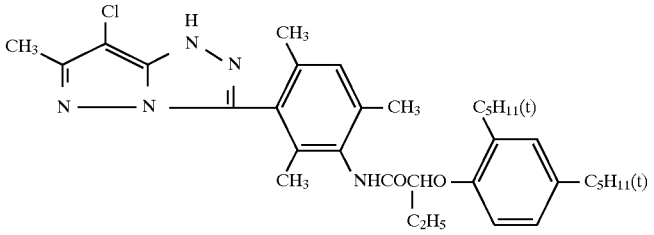
M-16
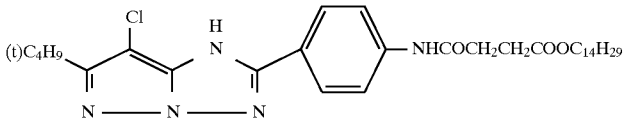
M-17
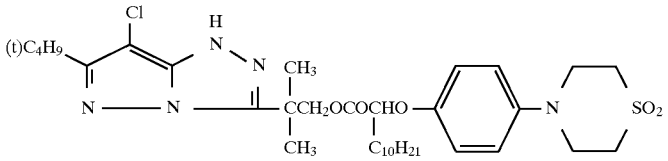
M-18
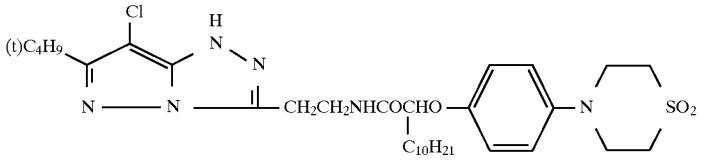
M-19
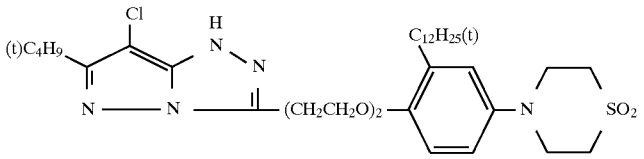
M-20
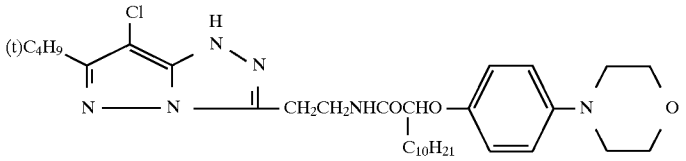
M-21
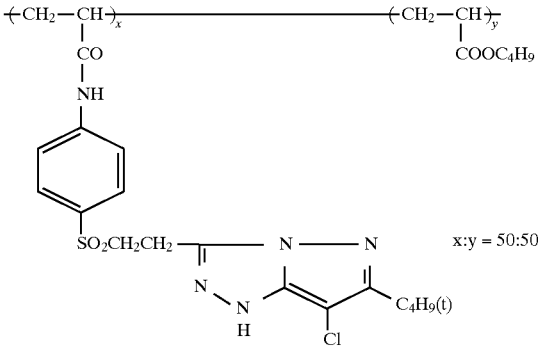
x:y = 50:50

-continued
M-22
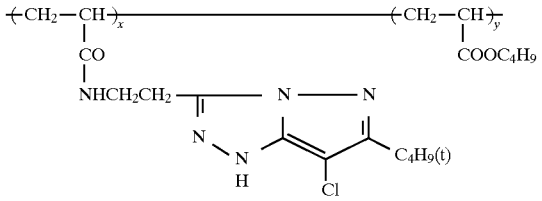
x:y = 50:50
M-23
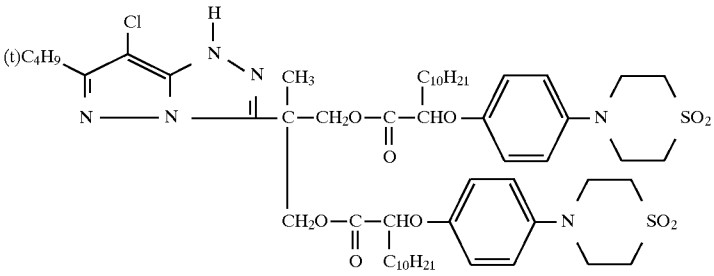
M-24
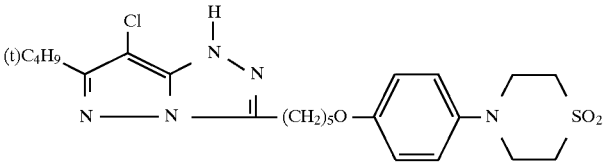
M-25
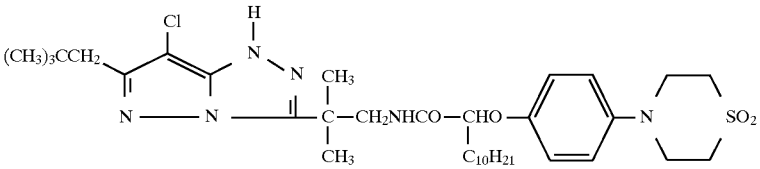
M-26
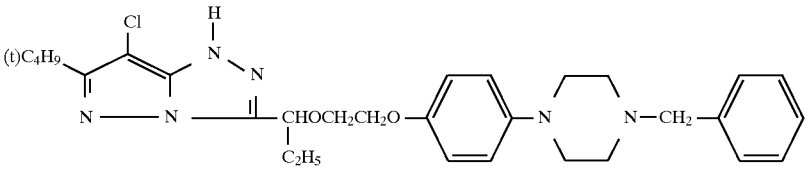
M-27
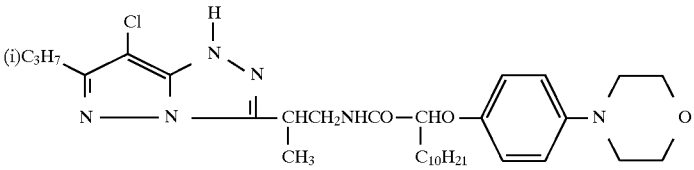
M-28
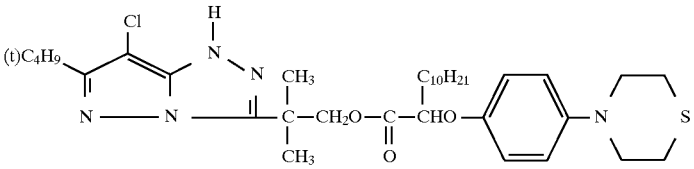
M-29
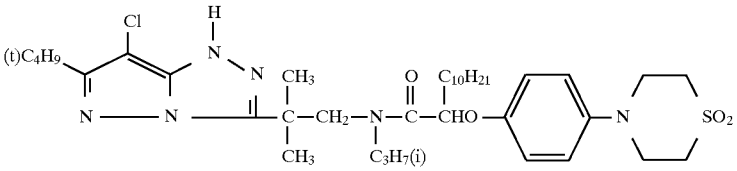

-continued

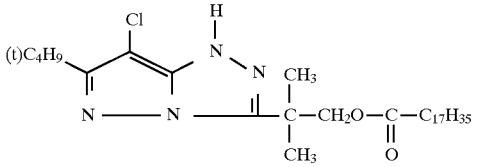

M-30

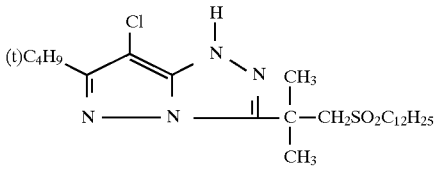

M-31

Besides the above couplers, the coupler used in the invention includes a compound represented by 1 through 7 described on page 6 of Japanese Patent O.P.I. Publication No. 61-292143/1986, exemplified compounds M-16 through M-34, M-37 through M-39, and M-41 through M-47 described on pages 106 through 114 of Japanese Patent O.P.I. Publication No. 62-215172/1987, exemplified compounds 1 through 64 described on pages 5 through 9 of Japanese Patent O.P.I. Publication No. 63-253946/1988, a compound represented by M-1 through M-15 described on pages 12 through 14 of Japanese Patent O.P.I. Publication No. 2-96133/1990, exemplified compounds M-1 through M-29 described on pages 5 through 6 of Japanese Patent O.P.I. Publication No. 2-100048/1990, exemplified compounds 1 through 11, 15, 16, 18 through 28 and 30 through 41 described on pages 19 through 32 of Japanese Patent O.P.I. Publication No. 3-125143/1991, exemplified compounds 1 through 24 described on pages 3 through 5 of Japanese Patent O.P.I. Publication No. 4-128744/1991, and exemplified compounds 1 through 22 described on pages 5 through 7 of Japanese Patent O.P.I. Publication No. 4-242249/1992.

The coupler used in the invention can be used in an amount of ordinarily $1\times10^{-3}$ to 1 mol, preferably $1\times10^{-2}$ to $7\times10^{-1}$ per 1 mol of silver halide.

In the invention the coupler and the alcoholic compound of the invention are contained in at least one light sensitive emulsion layer.

The coupler and the alcoholic compound of the invention are incorporated in silver halide emulsion layers according to the following. The conventional method comprises the steps of dissolving a coupler and an alcoholic compound singly or in combination in a mixture solvent of a high boiling point solvent such as dibutylphthalate or tricresylphosphate and a low boiling point solvent such as ethyl acetate or only in a low boiling point solvent, mixing the solution with a gelatin solution containing a surfactant, dispersing the resulting solution using a high speed rotating mixer, a colloid mill or a ultrasonic dispersing machine, and incorporating the resulting dispersion into a silver halide emulsion. After the above obtained dispersion is set, cut into pieces and washed with water, it may be incorporated into a silver halide emulsion.

In the invention the coupler and the alcoholic compound may be individually dispersed according to the above described method, but it is preferable that the coupler and the alcoholic compound are dispersed in combination, and incorporated in silver halide emulsion layers.

The addition amount of the alcohol in the invention is preferably 0.01 to 20 g, more preferably 0.1 to 8.0 g based on 1 g of coupler.

The silver halide composition may be any of silver chloride, silver bromide, silver bromochloride, silver bromoiodide, silver bromoiodochloride, and silver chloroiodide, but is preferably silver bromochloride containing 95 mol % of silver chloride and containing substantially no silver iodide. The silver bromochloride more preferably contains 97 mol % of silver chloride, and still more preferably contain 98 to 99.9 mol % of silver chloride.

In order to obtain such a silver halide emulsion, a silver halide emulsion comprising a high concentration of silver bromide is preferably used.

The above silver halide emulsion may be a silver halide emulsion layer comprising epitaxial depositions, a so-called core/shell emulsion, or a silver halide emulsion comprising in admixture silver halide grains different in halide composition. The silver halide grain composition may be varied continuously or discontinuously. The portions in which silver bromide comprises in a high concentration are especially preferably the corners of the surface of silver halide crystals.

The silver halide grains advantageously contain a heavy metal ion. The heavy metal ion includes an ion of the eighth to tenth group metal in the periodic table such as iron, iridium, platinum, palladium, nickel, rhodium, osmium, ruthenium or cobalt, the twelfth group metal in the periodic table such as cadmium, zinc or mercury, lead, rhenium, molybdenum, tungsten, gallium or chromium. Of these, an iridium, platinum, ruthenium, gallium and osmium ion are preferable. These metal ions are preferably added to a silver halide emulsion in the form of their salts or complexes.

When the heavy metal ions form complexes, a ligand or ligand ion includes a cyanide ion, a thiocyanate ion, a cyanate ion, a chloride ion, a bromide ion, an iodide ion, a nitrate ion, carbonyl and ammonia. Of these, a cyanide ion, a thiocyanate ion, an isothiocyanate ion, a chloride ion and a bromide ion are preferable.

In order to incorporate the heavy metal ion into a silver halide emulsion, the heavy metal compound may be added before or during silver halide grain formation or during physical ripening after the silver halide grain formation. In order to obtain a silver halide emulsion meeting the above described, a solution containing the heavy metal compound and a halide in admixture may be added continuously during silver halide grain formation.

The addition amount of the heavy metal compound is preferably $1\times10^{-9}$ to $1\times10^{-2}$, more preferably $1\times10^{-8}$ to $1\times10^{-5}$ based on 1 mol of silver halide.

The silver halide grains may be of any shape. The preferable example is a cube having (100) face as a crystal surface. The silver halide grains having octahedron, tetradecahedron or dodecahedron prepared according to the descriptions described in U.S. Pat. Nos. 4,183,756 and 4,225,666, Japanese Patent O.P.I. Publication Nos. 55-26589/1980 and Japanese Patent No. 55-42737/1980 may be used. Further, the silver halide grains having twin plains may be used.

The silver halide grains used in the invention is preferably of single shape, but two or more kinds of monodispersed silver halide emulsions are preferably contained in the same silver halide emulsion layer.

The grain size of the silver halide emulsion is not specifically limited, but is preferably 0.1 to 1.2 $\mu$m, and more preferably 0.2 to 1.0. This grain size can be measured using a projected area of the grains or an approximate diameter. When the grains are uniform, the grain size distribution can be considerably correctly expressed in terms of a diameter or a projected area.

The silver halide grains are monodispersed grains having a grain size distribution of a variation coefficient of preferably 0.22 or less, and more preferably 0.15 or less. Especially preferably, two or more kinds of the monodispersed grains having a grain size distribution of a variation coefficient of 0.15 or less are incorporated in the same silver halide emulsion layer. Herein, a variation coefficient shows the breadth of the grain size distribution, and is defined as the following expression:

Variation coefficient=S/R, wherein S represent a standard deviation of grain size distribution; and R represent an average grain size.

Herein, when the grains are spherical, grain size represents a diameter, and when the grains are cubic or not spherical, grain size represents a diameter of a circle corresponding to a projected area of the grains.

As an apparatus and a method for preparing silver halide emulsions, various conventional ones known in the field can be used.

The silver halide emulsions of the present invention may be prepared through any of those including an acid process, a neutral process and an ammonia process. Aforesaid grains may be grown directly, or may be grown after producing seed grains. A method for producing seed grains and a method for growing them may be the same or different.

In addition, as a method to cause soluble silver salt and a soluble halogenated salt to react, any of a normal precipitation method, a reverse precipitation method, a double-jet method and combination thereof are allowed. Of them, those obtained through a double-jet method is desirable. In addition, as one type of a double-jet method, pAg controlled double jet method described in Japanese Patent O.P.I. Publication No. 48521/1979 can also be used.

In addition, an apparatus disclosed in Japanese Patent O.P.I. Publication Nos. 92523/1982 and 92524/1982 wherein water-soluble silver salt and water-soluble halogenated compound salt aqueous solution is fed from an addition device placed in an initial solution for reaction, an apparatus disclosed in German Patent No. 2921164 wherein the concentration of water-soluble silver salt and water-soluble halogenated compound salt aqueous solution is continuously changed for adding, or an apparatus disclosed in Japanese Patent Publication No. 501776/1981 wherein grains are formed while the distance between each silver halide grain is kept constant by taking an initial solution outside of a reactor and concentrating it by the use of a ultra filtration method may be used.

In addition, if necessary, silver halide solvents such as thioether may be used. In addition, compounds having a mercapto group and compounds such as nitrogen-containing heterocycles or sensitizing dyes may be used by adding during formation of silver halide grains or after completion of forming grains.

The silver halide emulsion may be sensitized by the use of sensitizing methods using gold compounds and sensitizing methods using chalcogen sensitizers in combination.

As chalcogen sensitizers applicable, sulfur sensitizers, selenium sensitizers and tellurium sensitizers can be used. Among them, sulfur sensitizers are desirable. As sulfur sensitizers, thiosulfate, allylthiocarbamidothiourea, allylisothiacyanate, cystine, p-toluenethiosulfonate salt, rhodanine and an inorganic sulfur are cited. The added amount of sulfur sensitizers is different depending upon the kind of silver halide emulsion and intended effects, preferably $5\times10^{-10}$ to $5\times10^{-5}$ mol per mol of silver halide, and more preferably $5\times10^{-8}$ to $3\times10^{-5}$ mol per mol of silver halide.

The gold sensitizers applicable can be added in the form of gold chloride, silver chloride, gold sulfide, gold thiosulfate and various gold complex. As compounds to be used therein, dimethylrhodanine, thiocyanate, mercaptotetrazole and mercaptotriazole are cited. The added amount of gold compounds is different depending upon the kind of silver halide emulsion, kind of compounds used and ripening conditions, preferably $1\times10^{-4}$ to $1\times10^{-8}$ mol per mol of silver halide, and more preferably $1\times10^{-5}$ to $1\times10^{-8}$ mol per mol of silver halide.

As chemical sensitizing of the silver halide emulsion reduction sensitizing may be carried out.

In the silver halide emulsion, conventional anti-foggants and stabilizers can be used for preventing fog which occurs during preparation step of a silver halide photographic light-sensitive material, for reducing fluctuation in properties during storage and preventing fog which occurs when being developed. As an example of compounds used for such purposes, compounds represented by formula (II) described in the lower column on page 7 of Japanese Patent O.P.I. Publication No. 146036/1990 are cited. Practical examples thereof are compounds (IIa-1) through (IIa-8) and (II-b) through (IIb-7), 1-(3-methoxyphenyl)-5-mercaptotetrazole and 1-(4-ethoxyphenyl)-5-mercaptotetrazole are cited.

These compounds are added, depending upon their purposes, in a preparation step, in a chemical sensitization step, at the end of chemical sensitization step and in a preparation step for a coating solution. When chemical sensitization is carried out in the presence of these compounds, the addition amount of these compounds are preferably $1\times10^{-5}$ to $5\times10^{-4}$ per 1 mol of silver halide. When these compounds are added after completion of chemical sensitization, the addition amount of these compounds are preferably $1\times10^{-6}$ to $1\times10^{-2}$, and more preferably $1\times10^{31\ 5}$ to $5\times10^{-3}$ per 1 mol of silver halide. When these compounds are added to the silver halide emulsion during preparation of the coating solution, the addition amount of these compounds are preferably $1\times10^{-6}$ to $1\times10^{-1}$, and more preferably $1\times10^{-5}$ to $1\times10^{-2}$ per 1 mol of silver halide. When these compounds are added to coating layers other than silver halide emulsion layers, the content in the coating layer of these compounds are preferably $1\times10^{-9}$ to $1\times10^{-3}$ per $m^2$ of the coating layer.

To the silver halide photographic light-sensitive materials of the present invention, dyes having absorption ability for various wavelength can be used for preventing irradiation and halation. The conventional dyes can be used, and, dyes AI-1 to AI-11 described in Japanese Patent O.P.I. Publication No. 3-251840/1991, page 308 or dyes described in Japanese Patent O.P.I. Publication No. 6-3770/1994 are preferably used, as dyes having an absorption in the visible light wavelength region. The dyes represented by the general formula (I), (II) or (III) described in Japanese Patent O.P.I. Publication No. 1-280750/1989, page 2, lower left side are preferably used as infrared absorption dyes which have preferable spectral characteristic, in view of no adverse affect on photographic properties of photographic emulsions or staining due to remaining color. The preferable examples includes exemplified compounds (1) through (45) described in Japanese Patent O.P.I. Publication No. 1-280750/1989, page 3, lower left side through page 5, lower left side.

The addition amount of these dyes is preferably an amount necessary to give a spectral reflective density at 680 nm of preferably 0.5 or more, and more preferably 0.8 or more in non-processed light sensitive material, in view of sharpness improvement.

The light sensitive material preferably contains a brightening agent in view of white background improvement. The brightening agent preferably includes the compound represented by formula II described in Japanese Patent O.P.I. Publication No. 2-2326520/1990.

The light sensitive material of the invention includes a silver halide emulsion layer containing a yellow coupler, a magenta coupler and a cyan coupler in combination, which is sensitized in the specific range of 400 to 900 nm. The silver halide emulsion layer comprises one or more sensitizing dyes. The sensitizing dyes used are any conventional dyes. As a blue sensitive sensitizing dye, dyes BS-1 through BS-8 described in Japanese Patent O.P.I. Publication No. 3-251840/1991, page 28 are preferably used singly or in combination. As a green sensitive sensitizing dye, dyes GS-1 through GS-5 described in the same Japanese Patent O.P.I. Publication, page 28 are preferably used, and as a red sensitive sensitizing dye, dyes RS-1 through RS-8 described in the same Japanese Patent O.P.I. Publication, page 29 are preferably used. When imagewise exposure is carried out using an infrared light such as a semi-conductor laser, an infrared sensitizing dye needs to be used. In such case, as an infrared sensitive sensitizing dye, dyes IRS-1 through IRS-11 described in Japanese Patent O.P.I. Publication No. 4-285950/1992, pages 6 to 8 are preferably used. In addition to these infrared, red, green and blue sensitizing dyes, super sensitizers SS-1 through SS-9 described in Japanese Patent O.P.I. Publication No. 4-285950/1992, pages 8 to 9 or compounds S-1 through S-17 described in Japanese Patent O.P.I. Publication No. 5-66515/1993, pages 15 to 17 are preferably used in combination.

These sensitizing dyes are added in any step from silver halide grain formation to completion of chemical sensitization. The sensitizing dyes are added to the silver halide emulsion in the form of solution, in which the dyes are dissolved in water or a water-miscible organic solvent such as methanol, ethanol, fluorinated alcohol, acetone or dimethylformamide or their solid dispersion.

The preferable surfactant used in dispersing photographic additives or adjusting surface tension includes compounds which have a hydrophobic group with 8 to 30 carbon atoms and a sulfonic acid group or its salt group in a molecule. The examples include compounds A-1 to A-11 described in Japanese Patent O.P.I. Publication No. 62-26854/1987. The surfactant having a fluorinated alkyl group is preferably used. The dispersion solution of the compounds is usually added to a coating solution containing a silver halide emulsion. The time between their dispersion and their addition to the coating solution or the time between their addition and the coating is preferably shorter, each being preferably 10 hours or less, more preferably 3 hours or less and still more preferably 20 minutes or less.

The anti-fading additive is preferably added to each coupler layer in order to prevent discoloration of a formed dye image due to light, heat or humidity. The especially preferable compounds include phenylether compounds represented by formulas I to II described in Japanese Patent O.P.I. Publication No. 2-66541/1990, 3 page, phenol compounds A-1 to A-11 represented by formula IIIB described in Japanese Patent O.P.I. Publication No. 3-174150/1987, amine compounds represented by formula A described in Japanese Patent O.P.I. Publication No. 64-90445/1989, and metal complexes represented by formula XII, XIII, XIV or XV described in Japanese Patent O.P.I. Publication No. 62-182741/1987, which are preferable especially for a magenta dye. The compounds represented by formula I' described in Japanese Patent O.P.I. Publication No. 1-196049/1989 or compounds represented by formula II described in Japanese Patent O.P.I. Publication No. 5-11417/1993 are preferable for a yellow or cyan dye.

It is most preferable that an image stabilizer represented by Formula (S-1), which is an antifading agent for a magenta dye image, is contained in the silver halide emulsion layer containing a magenta image forming coupler.

In Formula (S-1), the aliphatic group represented by $R^{s1}$ and $R^{s2}$ includes an alkyl, alkenyl, alkinyl or cycloalkyl group, and may be straight-chained or branched and have a substituent. The substituent includes those as denoted in R of Formula (M-I).

In Formula (S-1), the aromatic group represented by $R^{s1}$ and $R^{s2}$ includes a phenyl or naphthyl group, and may have a substituent. The substituent includes those as denoted in $R^{s1}$ above.

In Formula (S-1), $R^{s1}$ and $R^{s2}$ are preferably an aliphatic group, and more preferably an alkyl group.

In Formula (S-1), $R^{s3}$ which is present on the benzene ring is not specifically limited, and represents preferably those as denoted in R of Formula (M-I). $R^{s3}$ is more preferably an alkyl, aryl or alkoxyl group or a halogen atom, and most preferably an alkyl group.

The typical examples of the image stabilizer represented by Formula (S-1) are listed below.

S-1

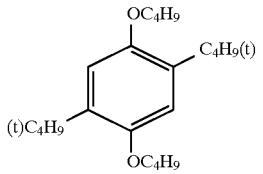

S-2

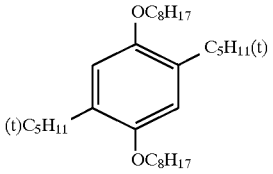

S-3

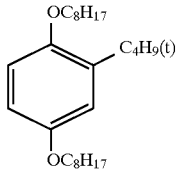

-continued

S-4

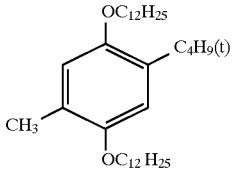

S-5

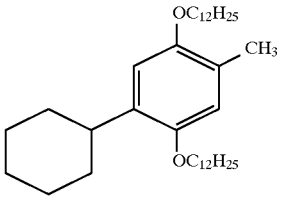

S-6

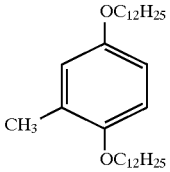

S-7

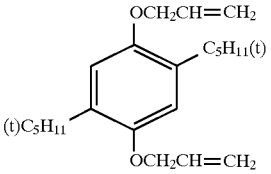

S-8

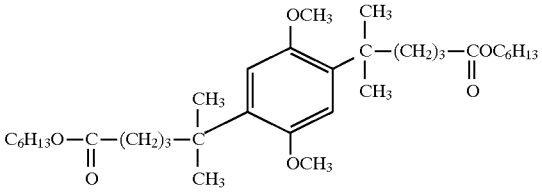

S-9

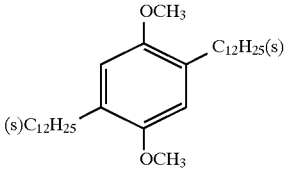

S-10

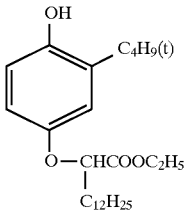

S-11

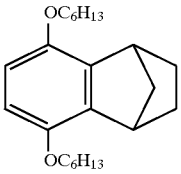

-continued

S-12

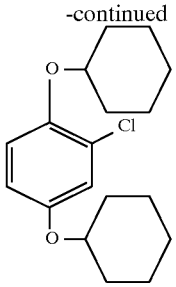

S-13

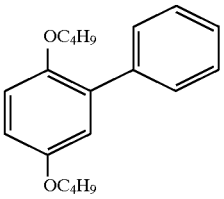

S-14

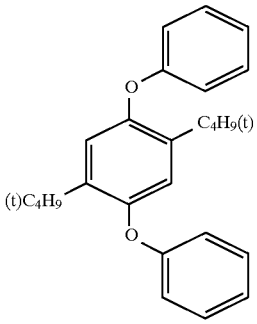

For the purpose of shifting an absorption wavelength of a color dye compound (d-11) described on pages 33 and compound (A'-1) described on pages 35 of Japanese Patent O.P.I. Publication No. 4-114152/1992 can be used. Besides the compounds, a fluorescent dye releasing compound disclosed in U.S. Pat. No. 4,774,187 are used.

The compound capable of reacting with an oxidation product of a color developing agent is preferably added to the layers between the two silver halide emulsion layers to prevent color mixture or to the silver halide emulsion layers to restrain fog. The compounds include preferably hydroquinone derivatives, more preferably dialkylhydroquinone such as 2,5-di-t-octylhydroquinone. The especially preferable compounds includes a compound represented by formula II described in Japanese Patent O.P.I. Publication No. 4-133056/1992, and compounds II-1 through II-14 on pages 13 and 14 and compound 1 described on page 17, of the same Japanese Patent.

The UV absorber is preferably added to light sensitive material to restrain static fog or to improve light fastness of a formed dye image. The preferable UV absorber includes benzotriazoles, and more preferably a compound represented by formula III-3 described in Japanese Patent O.P.I. Publication No. 1-250944/1989, a compound represented by formula III described in Japanese Patent O.P.I. Publication No. 64-66646/1989, UV-1L through UV-27L described in Japanese Patent O.P.I. Publication No. 63-187240/1988, a compound represented by formula I described in Japanese Patent O.P.I. Publication No. 4-1633/1992, and a compound represented by formula (I) or (II) described in Japanese Patent O.P.I. Publication No. 5-165144/1993.

For the silver halide photographic light-sensitive materials, it is advantageous to use gelatin as a binder. In addition, other gelatins, gelatin derivatives, graft polymers between gelatin and other polymers, proteins other than gelatin, sugar derivatives, cellulose derivatives and hydrophilic colloid such as synthetic hydrophilic polymers including homopolymers or copolymers can also be used if necessary.

The hardeners for a binder may be used. As hardeners, vinylsulfone type hardeners and chlorotriazine type hardeners are preferably used singly or in combination. The compounds described in Japanese Patent O.P.I. Publication Nos. 61-249054/1986 and 61-245153/1986 are preferably used. The antiseptic agent or anti-fungal described in Japanese Patent O.P.I. Publication No. 3-157646/1991 are preferably added to the colloid layer in order to prevent breed of bacilli or fungi which adversely affects photographic properties or image storage stability. The lubricant or matting agent described in Japanese Patent O.P.I. Publication Nos. 6-118543/1994 and 2-73250/1990 is preferably added to a protective layer in order to improve surface property of the non-processed or processed light sensitive material.

The support used in the color light sensitive material of the invention may be any material, and includes papers covered with polyethylene or polyethylene terephthalate, paper supports made of natural or synthetic pulp, a polyvinyl chloride sheet, polypropylene containing a white pigment, polyethyleneterephthalate support and baryta papers. The support comprising a paper and a water-proof resin layer provided on each side thereof is preferable. The water-proof resin preferably is polyethylene, polyethyleneterephthalate or their copolymer.

As white pigments to be used for the support, inorganic and/or organic white pigments can be used. The preferred are inorganic white pigments. For example, sulfate of alkaline earth metals such as barium sulfate, carbonate salts of alkaline earth metals such as calcium carbonate, silica such as fine silicate and synthetic silicate, calcium silicate, alumina, alumina hydrate, titanium oxide, zinc oxide, talc and clay are cited. The preferred white pigments are barium sulfate and titanium oxide.

The amount of white pigment contained in the water-proof resin layer on the surface of the support is preferable to be not less than 13% by weight, and more preferable to be not less than 15% by weight, in view of improved image sharpness.

The degree of dispersion of white pigment in the water-proof resin layer on a paper support used can be measured by means of a method described in Japanese Patent O.P.I. Publication No. 28640/1990. When measured by means of this method, the degree of dispersion of white pigment is preferable to be not more than 0.20, and more preferable to be not more than 0.15 in terms of fluctuation coefficient described in the aforesaid specification, in view of improved gloss. The white pigment containing water-proof resin layer of a paper support or hydrophilic colloid layer coated on a paper support preferably contains a bluing agent or reddening agent such as ultramarine or oil-soluble dyes in order to adjust a reflective density balance of white background after processing and to improve whiteness.

After the surface of the support is provided with corona discharge, UV ray irradiation and firing treatment if necessary, a light-sensitive materials may be coated directly or through subbing layers (one or two or more subbing layer in order to improve adhesiveness, anti-static property stability in sizing, anti-abrasion property, stiffness, anti-halation property, abrasion property and/or other properties of the surface of the support.)

When a light-sensitive materials using silver halide emulsions is coated, a thickener may be used. As coating methods, an extrusion coating method and a curtain coating method is especially advantageous because they can coat 2 or more layers concurrently.

An image forming method employing the color light sensitive material of the invention includes a method comprising printing on a photographic paper an image formed on a negative, a method comprising converting an image to digital information, displaying the image from the information on a CRT (cathode ray tube), and then printing the displayed image on a photographic paper, and a method comprising printing an image on a photographic paper by scanning a laser light which strength is varied based on digital information.

The invention is applied to preferably a light sensitive material containing no color developing agent, and more preferably a light sensitive material capable of forming an image for direct appreciation. The example includes color paper, color reversal paper, a light sensitive material capable of forming a positive image, a light sensitive material for display and a light sensitive material for color proof. The invention is applied to especially preferably a light sensitive material having a reflective support.

The aromatic primary amine color developing agents used in the present invention include a conventional compound. The examples will be shown below.

CD-1: N,N-Diethyl-p-phenylenediamine
CD-2: 2-Amino-5-diethylaminotoluene
CD-3: 2-Amino-5-(N-ethyl-N-laurylamino)toluene
CD-4: 4-(N-ethyl-N-β-hydroxyethyl)aminoaniline
CD-5: 2-Methyl-4-(N-ethyl-N-β-hydroxyethyl) aminoaniline
CD-6: 4-amino-3-methyl-N-ethyl-N-(β-methanesulfonamidoethyl)aniline
CD-7: 4-amino-3-(β-methanesulfonamidoethyl)-N,N-diethylaniline
CD-8: N,N-Dimethyl-p-phenylenediamine
CD-9: 4-Amino-3-methyl-N-ethyl-N-methoxyethylaniline
CD-10: 4-Amino-3-methyl-N-ethyl-N-(β-hydroxyethyl) aniline
CD-11: 4-Amino-3-methyl-N-ethyl-N-(γ-hydroxypropyl) aniline In the invention the pH of color developer may be any, but preferably within the range of 9.5 to 13.0, and more preferably within the range of 9.8 to 12.0 in view of rapid processing.

The color developing temperature is preferably 35° to 70° C. The temperature is preferably higher in view of shorter processing time, but is preferably not so high in view of processing stability. The developing is carried out at preferably 37° to 60° C.

The color developing is carried out ordinarily in about 3.5 minutes. The color developing is carried out preferably in not more than 40 seconds, and more preferably in not more than 25 seconds, in view of rapid processing.

The color developer may contain conventional developing components in addition to the above color developer. The developing components include an alkaline agent having a buffer effect, a chloride ion or a developing inhibitor such as benzotriazole, a preservative and a chelating agent.

The light sensitive material is color developed, bleached and then fixed. The bleaching may be carried out at the same time as fixing. After the fixing, washing is usually carried out. Stabilizing may be carried out instead of washing. The developing apparatus using development of light sensitive material may be a roller transport type which transports the light sensitive material sandwiched between the rollers or an endless belt type which transports the light sensitive material fixed on the belt. As a processing method is used a method of feeding light sensitive material and a processing solution into a slit-shaped processing tank, a method of processing light sensitive material jetting a processing solution, a web method of contacting light sensitive material with a carrier impregnated with a processing solution or a method of processing light sensitive material with a viscous processing solution. A large amount of light sensitive materials are usually running processed using an automatic processor. The replenishing amount of replenisher is preferably small, and the replenishing is most preferably carried out using replenisher tablets in view of environmental property. The replenishing method is most preferably a method described in Journal of Technical Disclosure 94-16935.

The invention will be explained according to the following examples, but is not limited thereto.

EXAMPLE 1

On both sides of paper pulp having a weight of 180 g/m$^2$, there was laminated high density polyethylene to prepare a paper support. However, on a side on which emulsion layers are coated, a fused polyethylene provided with surface treatment containing dispersed anatase type titanium oxide in an amount of 15 weight % was laminated to prepare a reflection support.

This reflection support was subjected to corona discharge, and was coated with a gelatin subbing layer. On the subbing layer, each layer shown in Tables 1 and 2 was coated to prepare a multi-layer silver halide color photographic light-sensitive material Sample 101. The coating solution was prepared as follow:

To 23.4 g of yellow coupler (Y-1), 3.34 g of each of dye image stabilizers (ST-1), (ST-2) and (ST-5), 0.34 g of anti-stain agent (HQ-1), 5.0 g of image stabilizer A, 3.33 g of high boiling organic solvent (DBP) and 1.67 g of high boiling organic solvent (DNP), 60 cc of ethyl acetate were added and dissolved. The solution was emulsified and dispersed into 220 ml of a 10% aqueous gelatin solution containing 7 cc of 20% surfactant (SU-1) by the use of a supersonic homogenizer to prepare a yellow coupler dispersion solution. This dispersion solution was mixed with the blue sensitive silver halide emulsion prepared according to the following to prepare a coating solution for the first layer.

The 2nd layer through the 7th layer were prepared to have a coating amount as shown in Tables 1 and 2 in the same manner as in the above-mentioned coating solution for the 1st layer.

In addition, as a hardener, (H-1) and (H-2) were added. As a coating aid, surfactants SU-2 and SU-3 were added to adjust a surface tension. Further, anti-fungal (F-1) was added in a total amount of 0.04 g/m$^2$.

TABLE 1

| Layer | Structure | Added amount (g/m$^2$) |
|---|---|---|
| 7th layer | Gelatin | 1.00 |
| (Protective layer) | DIDP | 0.002 |
| | DBP | 0.002 |
| | Silicone dioxide | 0.003 |
| 6th layer | Gelatin | 0.40 |
| (UV absorbing | AI-1 | 0.01 |
| layer) | UV absorber (UV-1) | 0.12 |
| | UV absorber (UV-2) | 0.04 |
| | UV absorber (UV-3) | 0.16 |
| | Anti-stain Agent (HQ-5) | 0.04 |
| | PVP | 0.03 |
| 5th layer | Gelatin | 1.30 |
| (Red sensitive | Red sensitive silver | 0.21 |
| layer) | bromochloride emulsion (Em-R) | |
| | Cyan coupler (EC-1) | 0.25 |
| | Cyan coupler (EC-2) | 0.08 |
| | Dye image stabilizer (ST-1) | 0.10 |
| | Anti-stain agent (HQ-1) | 0.004 |
| | DBP | 0.10 |
| | DOP | 0.20 |

TABLE 2

| Layer | Structure | Added amount (g/m$^2$) |
|---|---|---|
| 4th layer | Gelatin | 0.94 |
| (UV absorbing layer) | UV absorber (UV-1) | 0.28 |
| | UV absorber (UV-2) | 0.09 |
| | UV absorber (UV-3) | 0.38 |
| | AI-1 | 0.02 |
| | Anti-stain agent (HQ-5) | 0.10 |
| 3rd layer | Gelatin | 1.30 |
| (Green sensitive layer) | AI-2 | 0.01 |
| | Green sensitive silver bromochloride emulsion (Em-G) | 0.14 |
| | Magenta coupler (M-23) | 0.75* |
| | Dye image stabilizer (ST-3) | 0.20 |
| | Dye image stabilizer (ST-4) | 0.17 |
| | DNP | 0.20 |
| 2nd layer | Gelatin | 1.20 |
| (Intermediate layer) | AI-3 | 0.01 |
| | Anti-stain agent (HQ-2) | 0.03 |
| | Anti-stain agent (HQ-3) | 0.03 |
| | Anti-stain agent (HQ-4) | 0.05 |
| | Anti-stain agent (HQ-5) | 0.23 |
| | DIDP | 0.04 |
| | DBP | 0.02 |
| | Fluorescent brightening agent (W-1) | 0.10 |

TABLE 2-continued

| | | |
|---|---|---|
| 1st layer | Gelatin | 1.20 |
| (Blue sensitive layer) | Blue sensitive silver bromochloride emulsion (Em-B) | 0.26 |
| | Yellow coupler (EY-1) | 0.70 |
| | Dye image stabilizer (ST-1) | 0.10 |
| | Dye image stabilizer (ST-2) | 0.10 |
| | Dye image stabilizer (ST-5) | 0.10 |
| | Anti-stain agent (HQ-1) | 0.01 |
| | Image stabilizer A | 0.15 |
| | DNP | 0.05 |
| | DBP | 0.15 |
| Support | Paper laminated with polyethylene (containing minute colorant) | |

The added amount of the silver halide emulsion is illustrated in terms of silver. *millimol/$m^2$
SU-1: Sodium tri-i-propylnaphthalene sulfonate
SU-2: Sodiumsulfo di-(2-ethylhexyl)succinate
SU-3: Sodiumsulfo di-(2,2,3,3,4,4,5,5-octafluoropentyl)-succinate
DBP: Dibutylphthalate
DNP: Dinonylphthalate
DOP: Dioctylphthalate
DIDP: Diisodecylphthalate
PVP: Polyvinylpyrrolidone
H-1: Tetrakis(vinylsulfonylmethyl)methane
H-2: Sodium 2,4-dichloro-6-hydroxy-s-triazine
HQ-1: 2,5-Di-t-octylhydroquinone
HQ-2: 2,5-Di-sec-dodecylhydroquinone
HQ-3: 2,5-Di-sec-tetradecyllhydroquinone
HQ-4: 2-Sec-dodecyl-5-sec-tetradecylhydroquionone
HQ-5: 2,5-Di-(1,1-dimethyl-4-hexyloxycarbonyl)butylhydroquinone
A: p-Octylphenol
EY-1

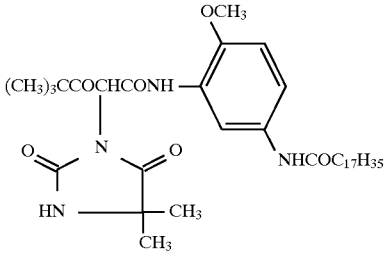

EC-1

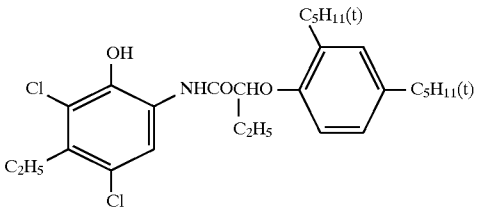

EC-2

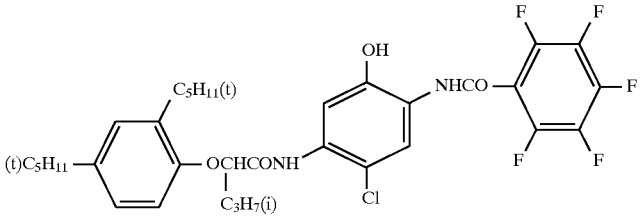

ST-1

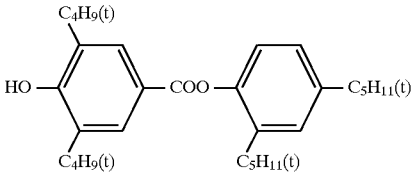

TABLE 2-continued
ST-2
ke
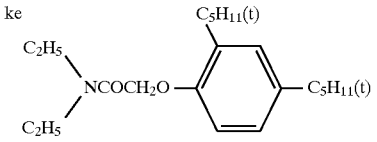
ST-3
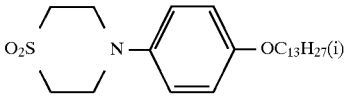
ST-4
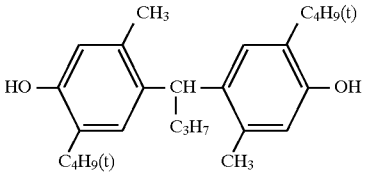
ST-5
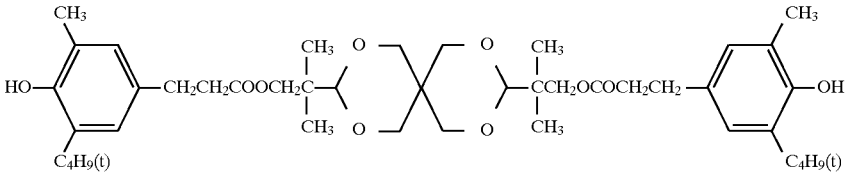
UV-1
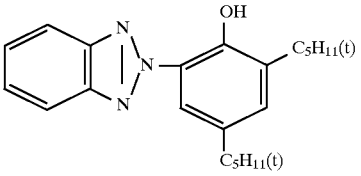
UV-2
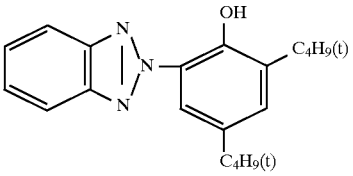
UV-3
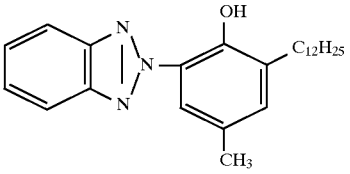
AI-1
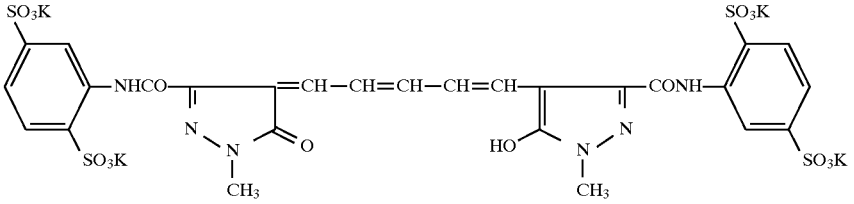

TABLE 2-continued

AI-2

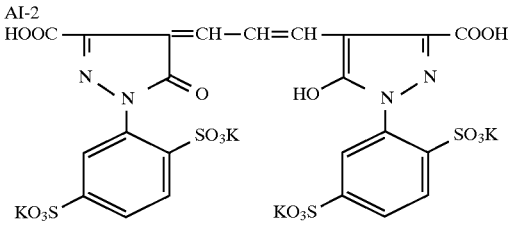

AI-3

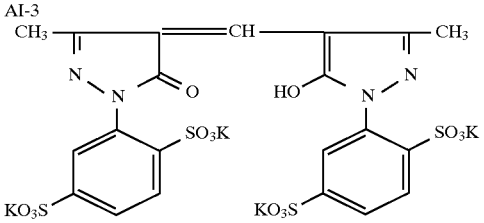

W-1

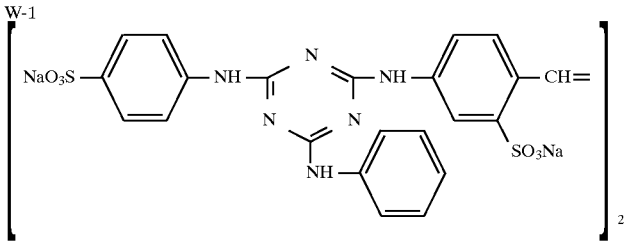

F-1

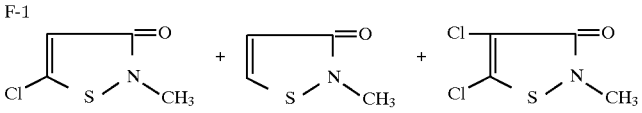

(50%) (46%) (4%) mol ratio (Preparation of blue sensitive silver halide emulsion)

To 1 liter of a 2% aqueous gelatin solution kept at 40° C., the following Solutions A and B were concurrently added spending 30 minutes while pAg was controlled to 7.3 and pH was controlled to 3.0, and then, the following Solution C and D were concurrently added spending 180 minutes while pAg as controlled to 8.0 and pH was controlled to 5.5. The pAg was adjusted according to descriptions of Japanese Patent O.P.I. Publication No. 59-45437/1984, and the pAg was controlled with an aqueous sulfuric acid or sodium hydroxide solution.

(Solution A)

Sodium chloride 3.42 g

Potassium bromide 0.03 g

Water was added to make a 200 cc solution.

(Solution B)

Sodium nitrate 10 g

Water was added to make a 200 cc solution.

(Solution C)

$K_2IrCl_6$ $4\times10^{-8}$ mol

Sodium chloride 102.7 g $K_4Fe(CN)_6$ $2\times10^{-5}$ mol

Potassium bromide 1.0 g

Water was added to make a 600 cc solution.

(Solution D)

Sodium nitrate 300 g

Water was added to make a 600 cc solution.

After the addition was completed, the solution was subjected to desalting by the use of a 5% aqueous solution of Demol N produced by Kao Atlas Co., Ltd. and a 20% aqueous solution of magnesium sulfate. Then, the resulting solution was mixed with an aqueous gelatin solution to prepare a mono-dispersed cubic emulsion EMP-1 having an average grain size of 0.71 μm, a variation coefficient of grain size distribution of 0.07 and a silver chloride content of 99.5 mol %.

The mono-dispersed cubic emulsion EMP-1B was prepared in the same manner as in EMP-1, except that the addition time of Solutions A And B, and the addition time of Solutions C And D were varied. The emulsion EMP-1B had an average grain size of 0.64 μm, a variation coefficient of grain size distribution of 0.07 and a silver chloride content of 99.5 mol %.

The above-mentioned emulsions EMP-1 and EMP-1B were subjected to the most suitable sensitization employing the following compounds. Then, the sensitized EMP-1 and EMP-1B were mixed in a ratio (in terms of silver) of 1:1 to obtain a blue sensitive silver halide emulsion (Em-B).

Sodium thiosulfate 0.8 mg/mol Ag

Chloroauric acid 0.5 mg/mol Ag

Stabilizer STAB-1 $3\times10^{-4}$ mol/mol Ag

Stabilizer STAB-2 $3\times10^{-4}$ mol/mol Ag

Stabilizer STAB-3 $3\times10^{-4}$ mol/mol Ag

Sensitizer BS-1 $4\times10^{-4}$ mol/mol Ag

Sensitizer BS-2 $1\times10^{-4}$ mol/mol Ag (Preparation of green sensitive silver halide emulsion)

The mono-dispersed cubic emulsion EMP-2 was prepared in the same manner as in EMP-1, except that the addition time of Solutions A And B, and the addition time of Solutions C And D were varied. The emulsion EMP-2 had an average grain size of 0.40 μm, a variation coefficient of 0.08 and a silver chloride content of 99.5 mol %. The mono-dispersed cubic emulsion EMP-2B was prepared in the same manner as in EMP-2. The emulsion EMP-2B had an average grain size of 0.38 μm, a variation coefficient of 0.08 and a silver chloride content of 99.5 mol %.

The above-mentioned emulsions EMP-2 and EMP-2B were subjected to the most suitable sensitization employing the following compounds. Then, the sensitized EMP-2 and EMP-2B were mixed in a ratio (in terms of silver) of 1:1 to obtain a green sensitive silver halide emulsion (Em-G).

Sodium thiosulfate 1.5 mg/mol Ag

Chloroauric acid 1.0 mg/mol Ag

Stabilizer STAB-1 $3\times10^{-4}$ mol/mol Ag

Stabilizer STAB-2 $3\times10^{-4}$ mol/mol Ag

Stabilizer STAB-3 $3\times10^{-4}$ mol/mol Ag

Sensitizer GS-1 $4\times10^{-4}$ mol/mol Ag (Preparation of red sensitive silver halide emulsion)

The mono-dispersed cubic emulsion EMP-3 was prepared in the same manner as in EMP-1, except that the addition time of Solutions A And B, and the addition time of Solutions C And D were varied. The emulsion EMP-3 had an average grain size of 0.40 μm, a variation coefficient of 0.08 and a silver chloride content of 99.5 mol %. The mono-dispersed cubic emulsion EMP-3B was prepared in the same manner as in EMP-3B. The emulsion EMP-3B had an average grain size of 0.38 μm, a variation coefficient of 0.08 and a silver chloride content of 99.5 mol %.

The above-mentioned emulsions EMP-3 and EMP-3B were subjected to the most suitable sensitization employing the following compounds. Then, the sensitized EMP-3 and EMP-3B were mixed in a ratio (in terms of silver) of 1:1 to obtain a red sensitive silver halide emulsion (Em-R).

Sodium thiosulfate 1.8 mg/mol Ag

Chloroauric acid 2.0 mg/mol Ag

Stabilizer STAB-1 $3\times10^{-4}$ mol/mol Ag

Stabilizer STAB-3 $3\times10^{-4}$ mol/mol Ag

Sensitizer RS-1 $1\times10^{-4}$ mol/mol Ag

Sensitizer RS-2 $1\times10^{-4}$ mol/mol Ag

Super sensitizer SS-2 $2\times10^{-3}$ mol/mol Ag

STAB-1: 1-(3-acetoamidophenyl)-5-mercaptotetrazole

STAB-1: 1-phenyl-5-mercaptotetrazole

STAB-1: 1-(4-ethoxyphenyl)-5-mercaptotetrazole

BS-1

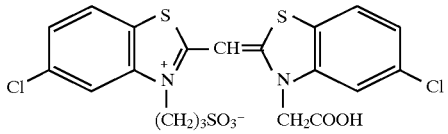

BS-2

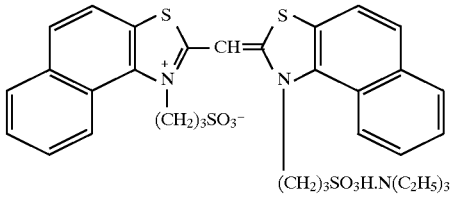

GS-1

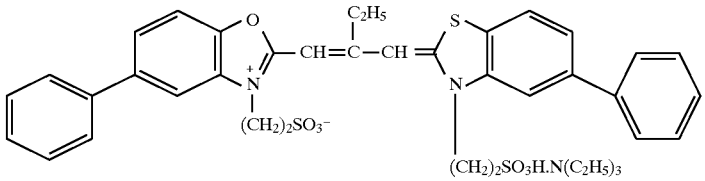

RS-1

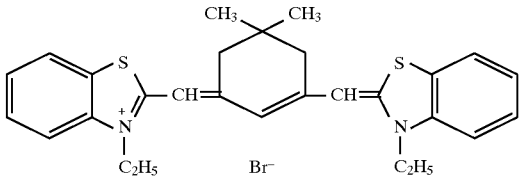

RS-2

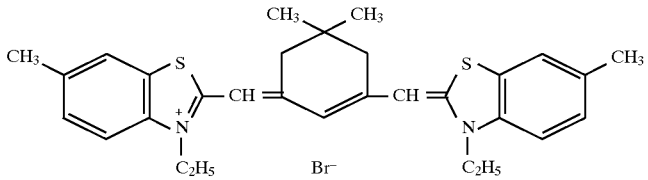

-continued

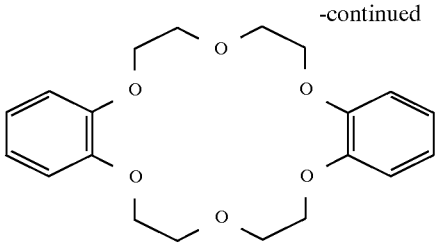

SS-1

Light-sensitive material samples 102 through 122 were prepared in the same manner as in sample 101, except that the magenta coupler in the third layer of sample 101 was varied as shown in Table 3 and the high boiling point solvent in the third layer of sample 101 was also replaced with the inventive alcoholic compound or a comparative high boiling point solvent as shown in Table 3.

The above obtained samples were wedge exposed according to a conventional method, and processed according to the following developing processes. The amount of replenishing is in terms of light sensitive material to be processed.

| Processing step | Processing temperature | Time | Amount of replenishing |
|---|---|---|---|
| Color developing | 38.0 ± 0.3° C. | 45 seconds | 80 cc |
| Bleach-fixing | 35.0 ± 0.5° C. | 45 seconds | 120 cc |
| Stabilizing | 30–34° C. | 60 seconds | 150 cc |
| Drying | 60–80° C. | 30 seconds | |

The following shows a composition of a color developing solution.

Color developer and color developer replenisher

| | Color developer | Color developer replenisher |
|---|---|---|
| Pure water | 800 cc | 800 cc |
| Triethylenediamine | 2 g | 3 g |
| Diethylene glycol | 10 g | 10 g |
| Potassium bromide | 0.01 g | |
| Potassium chloride | 3.5 g | |
| Potassium sulfite | 0.25 g | 0.5 g |
| N-ethyl-N-(β-methanesulfonamidoethyl)-3-methyl-4-aminoaniline sulfate | 6.0 g | 10.0 g |
| N,N-diethylhydroxylamine | 6.8 g | 6.0 g |
| Triethanolamine | 10.0 g | 10.0 g |
| Sodium diethylenetriamine pentaacetate | 2.0 g | 2.0 g |
| Fluorescent brightening agent (4,4-diaminostylbenzsulfonate derivative) | 2.0 g | 2.5 g |
| Potassium carbonate | 30 g | 30 g |

Water was added to make 1 l in total. The pH's of color developer and color developer replenisher were regulated to 10.10 and 10.60, respectively.

Bleach fixer and bleach fixer replenisher

| | |
|---|---|
| Diethylenetriamine pentaacetate ferric ammonium dihydrate | 65 g |
| Diethylenetriamine pentaacetate | 3 g |
| Ammonium thiosulfate (70% aqueous solution) | 100 cc |
| 2-Amino-1,3,4-thiadiazole-2-thiol | 2.0 g |
| Ammonium thiosulfate (40% aqueous solution) | 27.5 cc |

Water was added to make 1 liter in total, and pH was regulated to 5.7 with potassium carbonate or glacial acetic acid.

Stabilizer and stabilizer replenisher

| | |
|---|---|
| Orthophenylphenol | 1.0 g |
| 5-chloro-2-methyl-4-isothiazoline-3-on | 0.02 g |
| 2-methyl-4-isothiazoline-3-on | 0.02 g |
| Diethyleneglycol | 1.0 g |
| Fluorescent brightening agent (Thinopal SFP) | 2.0 g |
| 1-hydroxyethilidene-1,1-diphosphonic acid | 1.8 g |
| Bismuth chloride (45% aqueous solution) | 0.65 g |
| Magnesium sulfate heptahydrate | 0.2 g |
| PVP | 1.0 g |
| Aqueous ammonia (25% aqueous solution of ammonium hydroxide) | 2.5 g |
| Trisodium nitrilotriacetate | 1.5 g |

Water was added to make 1 liter in total, and pH was regulated to 7.5 with sulfuric acid or aqueous ammonia.

According to the following methods, the above processed samples were evaluated for dye-forming efficiency and light fastness of a formed image, and the unexposed samples after storage were evaluated for color mixture.

(Dye-forming efficiency)

The blue light reflection density ($D^B$ max) and green light reflection density ($D^G$ max) at the maximum density portions were measured using a densitometer PDA-65 (produced by Konica Corporation) and was designated as a measure of color reproduction.

(Light fastness)

The samples were placed in a glass box, and exposed to a sun light through the glass for 3 months. The green light reflection density of the samples before and after the exposure were measured using a densitometer PDA-65. The degree of color fading (fading rate) was calculated according to the following equation:

$$\text{Fading rate } (\%)=(D_0-D)\times 100/D_0$$

wherein $D_0$ represents a reflection density before the exposure, and D represents a reflection density after the exposure at 1.0 density portions before the exposure.

(Color mixture)

The unexposed samples were stored at 55° C. and at 40% RH for 16 hours. Thereafter, the resulting samples were wedge exposed to a red light, and processed according to the above processing steps. The green light reflection density ($D_{G/R}$) of the processed samples were measured at portions having a red light reflection density of 1.0. The unexposed samples before the storage were similarly wedge exposed and processed, and the green light reflection density ($D_{0G/R}$) of the processed samples were measured at portions having a red light reflection density of 1.0. The difference ($\Delta G_{G/R}$) between ($D_{G/R}$) and ($D_{0G/R}$) was used as a measure of color mixture.

TABLE 3

| Sample No. | Third layer Magneta coupler | Third layer Organic solvent | Light fastness (%) | ($D^B$ max) | ($D^G$ max) | $\Delta G_{G/R}$ |
|---|---|---|---|---|---|---|
| 101 (Comp.) | M-7 | DNP | 30 | 2.23 | 2.40 | 0.021 |
| 102 (Comp.) | M-7 | HBS-1 | 30 | 2.22 | 2.46 | 0.070 |
| 103 (Comp.) | M-7 | HBS-2 | 36 | 2.25 | 2.44 | 0.060 |
| 104 (Comp.) | M-7 | HBS-3 | 32 | 2.28 | 2.43 | 0.080 |
| 105 (Inv.) | M-7 | A-23 | 25 | 2.30 | 2.47 | 0.020 |
| 106 (Inv.) | M-7 | A-22 | 23 | 2.30 | 2.52 | 0.028 |
| 107 (Inv.) | M-7 | A-21 | 22 | 2.29 | 2.50 | 0.021 |
| 108 (Inv.) | M-7 | A-20 | 23 | 2.31 | 2.51 | 0.024 |
| 109 (Inv.) | M-7 | A-4 | 19 | 2.30 | 2.52 | 0.005 |
| 110 (Inv.) | M-7 | A-7 | 16 | 2.32 | 2.53 | 0.002 |
| 111 (Inv.) | M-7 | A-14 | 18 | 2.33 | 2.57 | 0.008 |
| 112 (Comp.) | M-16 | DNP | 21 | 2.21 | 2.35 | 0.019 |
| 113 (Comp.) | M-16 | HBS-1 | 29 | 2.28 | 2.45 | 0.085 |
| 114 (Inv.) | M-16 | A-7 | 13 | 2.28 | 2.47 | 0.008 |
| 115 (Comp.) | M-17 | DNP | 26 | 2.22 | 2.38 | 0.018 |
| 116 (Comp.) | M-17 | HBS-1 | 30 | 2.29 | 2.45 | 0.050 |
| 117 (Inv.) | M-17 | A-7 | 14 | 2.33 | 2.55 | 0.002 |
| 118 (Inv.) | M-7 | A-17 | 21 | 2.30 | 2.46 | 0.008 |
| 119 (Inv.) | M-16 | A-22 | 18 | 2.26 | 2.43 | 0.021 |
| 120 (Inv.) | M-16 | A-14 | 14 | 2.27 | 2.49 | 0.007 |
| 121 (Inv.) | M-17 | A-22 | 21 | 2.29 | 2.48 | 0.019 |
| 122 (Inv.) | M-17 | a-14 | 13 | 2.32 | 2.56 | 0.005 |

HBS-2: $C_{18}H_{17}CH{=}CH(CH_2)OH$ (high boiling point organic solvent described in FP489, 929)
HBS-3: Dodecyl alcohol (high boiling point organic solvent described in Japanese Patent O.P.I. Publication No. 53-13414/78)

As is apparent from the above, inventive samples 105 through 111, 114 and 117 through 122 provide excellent color reproduction and light fastness, and reduced color mixture after storage.

EXAMPLE 2

Light-sensitive material samples 211 through 218 were prepared in the same manner as in Sample 101 of Example 1, except that, in the third layer, magenta coupler M-7 was replaced with magenta coupler 18 as shown in Table 4, the high boiling point solvent DNP was replaced with the high boiling point solvent as shown in Table 4 in an amount shown in Table 4 and neither ST-3 nor ST-4 was used.

The samples obtained above were exposed and processed in the same manner as in Example 1, and evaluated for dye-forming efficiency and light fastness in the same manner as in Example 1.

Regarding light fastness, samples were exposed for 400 hours, employing a 70,000 lux xenon Fade-O-meter, and then processed and evaluated in the same manner as in Example 1.

Further, the bleed degree of the dye image under high temperature and humidity was evaluated according to the following:

The samples were exposed to a white light through a sharpness evaluation pattern which had been brought into contact with the samples, and processed in the same manner as above described. The processed samples were stored at 85° C. and 60% RH for 14 days. Thereafter, the bleed degree of the dye image of the resulting samples was visually observed. The evaluation criteria were as follows:

A: No dye image bleed

B: Slight dye image bleed occurs.

C: Dye image bleed occurs.

D: Dye image bleed markedly occurs.

The results are shown in Table 4.

TABLE 4

| Sample No. | Third layer Magenta coupler | Third layer Organic solvent (Addition amount, g/m²) | Light fastness (fading rate, %) | $D^G$max | Bleed degree | Total carbon number of $R^{1a}$ and $R^{a2}$ |
|---|---|---|---|---|---|---|
| 211(Comp.) | M-18 | DNP-(0.57) | 64 | 2.34 | D | — |
| 212(Comp.) | M-18 | HBS-2(0.57) | 76 | 2.36 | D | — |
| 213(Comp.) | M-18 | HBS-4(0.57) | 32 | 2.44 | D | 10 |
| 214(Comp.) | M-18 | HBS-5(0.57) | 30 | 2.47 | C | 40 |
| 215(Inv.) | M-18 | A-1(0.57) | 24 | 2.50 | A | 18 |
| 216(Inv.) | M-18 | A-2(0.57) | 26 | 2.51 | A | 12 |
| 217(Inv.) | M-18 | A-10(0.57) | 27 | 2.48 | A | 36 |
| 218(Inv.) | M-18 | A-14(0.57) | 30 | 2.53 | A | 14 |

HBS-4

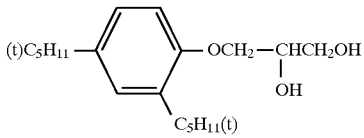

HBS-5

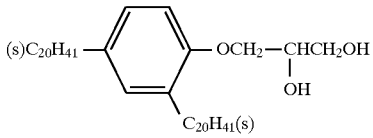

As is apparent from Table 4, when the alcoholic compound represented by formula (A), in which the total carbon number of $R^{a1}$ and $R^{a2}$ is 12 to 36, is used as an high boiling point organic solvent for a magenta coupler, the dye image bleed under high temperature and humidity is effectively minimized.

When the carbon number is less than 12, a cyan image bleed was observed, and when the carbon number is not less than 37, a magenta image bleed was observed, but no dye image bleed was observed in samples 215 through 218 in which the alcoholic compounds having a total carbon number of $R^{a1}$ and $R^{a2}$ of 12 to 36 were used.

What is claimed is:

1. A silver halide color photographic material comprising a support and provided thereon, a silver halide emulsion layer, the silver halide emulsion layer comprising an alcoholic compound represented by the following formula (A):

formula (A)

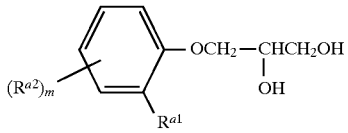

wherein $R^{a1}$ represents an alkyl, alkenyl, alkoxy, aryloxy, acyl, acylamino, carbamoyl, alkoxycarbonyl, aryloxycarbonyl, cyano, sulfonyl or hydroxy group or a halogen atom; $R^{a2}$ represents a hydrogen atom, an alkyl, alkenyl, alkoxy, aryloxy, acyl, acylamino, carbamoyl, alkoxycarbonyl, aryloxycarbonyl, cyano, sulfonyl or hydroxy group or a halogen atom; and m is an integer of 0 to 4, provided that the total carbon atom number contained in $R^{a1}$ and $R^{a2}$ is 12 to 36.

2. The silver halide color photographic material of claim 1, wherein said $R^{a1}$ in formula (A) represents an alkyl group.

3. The silver halide color photographic material of claim 1, wherein said silver halide emulsion layer further comprises a coupler and said coupler and said alcoholic compound are present in said emulsion layer as an admixture.

4. The silver halide color photographic material of claim 3, wherein said silver halide emulsion layer contains said coupler in an amount of $1\times10^{-3}$ to 1 mol per mol of silver halide and said alcoholic compound in an amount of 0.01 to 20 g per 1 g of coupler.

5. The silver halide color photographic material of claim 4, wherein said silver halide emulsion layer contains said alcoholic compound in an amount of 0.1 to 2.0 g per 1 g of coupler.

6. The silver halide color photographic material of claim 3, wherein said coupler is a magenta coupler represented by the following formula (M-I):

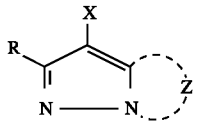

wherein Z represents an non-metallic atomic group necessary to form a nitrogen containing heterocyclic ring, wherein Z may have a substituent; X represents a hydrogen atom or a group capable of being released on reaction with an oxidation product of a color developing agent; and R represents a hydrogen atom, alkyl, aryl, anilino, acylamino, sulfonamido, alkylthio, arylthio, alkenyl, cycloalkyl, a halogen atom, cycloalkenyl, alkynyl, heterocyclic, sulfonyl, sulfinyl, phosphonyl, acyl, carbamoyl, sulfamoyl, cyano, alkoxy, aryloxy, heterocylicoxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclicthio, a spiro compound residue or a closslinked hydrocarbon compound residue.

7. The silver halide color photographic material of claim 6, wherein said magenta coupler is represented by the following formula (M-A):

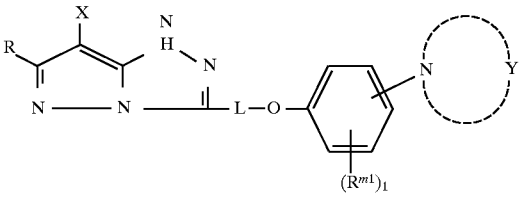

wherein R and $R^{m1}$ independently represent a hydrogen atom, alkyl, aryl, anilino, acylamino, sulfonamido, alkylthio, arylthio, alkenyl, cycloalkyl, a halogen atom, cycloalkenyl, alkynyl, heterocyclic, sulfonyl, sulfinyl, phosphonyl, acyl, carbamoyl, sulfamoyl, cyano, alkoxy, aryloxy, heterocylicoxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclicthio, a spiro compound residue or a closslinked hydrocarbon compound residue; L represents a divalent linkage group; Y represents an non-metallic atomic group necessary to form a 5- or 6-member heterocyclic ring; and 1 is an integer of 0 to 4.

8. The silver halide color photographic material of claim 1, wherein said silver halide emulsion layer further contains an image stabilizer represented by the following formula (S-I):

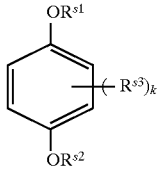

wherein $R^{s1}$ and $R^{s2}$ independently represent a hydrogen atom, an aliphatic group or an aromatic group; $R^{s3}$ represents a hydrogen atom, alkyl, aryl, anilino, acylamino, sulfonamido, alkylthio, arylthio, alkenyl, cycloalkyl, a halogen atom, cycloalkenyl, alkynyl, heterocyclic, sulfonyl, sulfinyl, phosphonyl, acyl, carbamoyl, sulfamoyl, cyano, alkoxy, aryloxy, heterocylicoxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclicthio, a spiro compound residue or a closslinked hydrocarbon compound residue; and k is an integer of 0 to 4, provided that when k is 2 or more, plural $R^{s3}$ may be the same or different, when plural $R^{s3}$ are adjacent to each other, plural $R^{s3}$ may combine with each other to form a ring, and $R^{s1}$ and $R^{s2}$ are not simultaneously hydrogen atoms.

9. A silver halide color photographic material comprising a support and provided thereon, a silver halide emulsion layer, the silver halide emulsion layer comprising an alcoholic compound represented by the following formula (A1):

formula (A1)

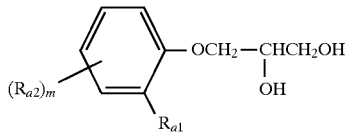

wherein $R_{a1}$ and $R_{a2}$ each represent a (t,s) $C_9H_{19}$ group; and and m is an integer of 1 to 3, provided that the total carbon atom number contained in $R_{a1}$ and $R_{a2}$ is 18 to 36.

10. The silver halide color photographic material of claim 9, wherein said alcoholic compound is represented by the following formula:

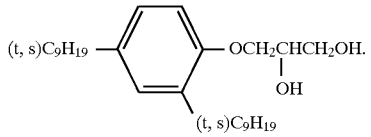

11. The silver halide color photographic material of claim 10, wherein said silver halide emulsion layer contains a coupler in an amount of $1\times10^{-3}$ to 1 mol per mol of silver halide and said alcoholic compound in an amount of 0.01 to 20 g per 1 g of coupler.

12. The silver halide color photographic material of claim 1, wherein said silver halide emulsion layer contains silver halide grains having a silver chloride content of 95 mol % or more.

* * * * *